US010429116B2

(12) United States Patent
Huish

(10) Patent No.: US 10,429,116 B2
(45) Date of Patent: Oct. 1, 2019

(54) PORTABLE COOLER WITH ACCESSORY ATTACHMENT RAILS

(71) Applicant: Alan John Huish, Pinedale, WY (US)

(72) Inventor: Alan John Huish, Pinedale, WY (US)

( * ) Notice: Subject to any disclaimer, the term of this patent is extended or adjusted under 35 U.S.C. 154(b) by 66 days.

(21) Appl. No.: 15/495,102

(22) Filed: Apr. 24, 2017

(65) Prior Publication Data

US 2018/0038624 A1 Feb. 8, 2018

Related U.S. Application Data

(60) Provisional application No. 62/370,534, filed on Aug. 3, 2016.

(51) Int. Cl.

| | |
|---|---|
| ***F25D 3/08*** | (2006.01) |
| ***F25D 31/00*** | (2006.01) |
| ***A45C 13/26*** | (2006.01) |
| ***A45C 5/14*** | (2006.01) |
| ***A45C 11/20*** | (2006.01) |

(52) U.S. Cl.

CPC ..... *F25D 3/08* (2013.01); *A45C 5/14* (2013.01); *A45C 11/20* (2013.01); *A45C 13/262* (2013.01); *F25D 31/00* (2013.01)

(58) Field of Classification Search

CPC ... F25D 3/08; F25D 31/00; A45C 5/14; A45C 11/20; A45C 13/262

USPC ..... 224/524

See application file for complete search history.

(56) References Cited

U.S. PATENT DOCUMENTS

| | | | | |
|---|---|---|---|---|
| 3,543,432 | A * | 12/1970 | Gates | A01K 97/10 248/511 |
| 4,353,182 | A * | 10/1982 | Junkas | A01K 97/06 206/315.11 |
| 5,938,023 | A * | 8/1999 | Herron | B25H 3/023 206/315.11 |
| 6,076,298 | A * | 6/2000 | Teel | A01K 97/22 43/54.1 |
| 6,185,860 | B1 * | 2/2001 | Thibodeaux | A01K 97/06 206/315.11 |
| 6,467,779 | B1 * | 10/2002 | Mills | A01K 97/06 224/922 |
| 7,032,753 | B2 * | 4/2006 | Purvis | B65D 81/3813 206/459.5 |
| 7,389,608 | B1 * | 6/2008 | MacKay | A01K 97/05 206/315.11 |
| 8,375,622 | B1 * | 2/2013 | Holzmann, Jr. | A01K 97/10 43/21.2 |
| 9,282,797 | B1 * | 3/2016 | Soto | A45C 11/20 |
| 9,433,200 | B2 * | 9/2016 | Norman | A01K 97/08 |
| 9,462,796 | B1 * | 10/2016 | Ellis | A01K 97/22 |
| 10,167,184 | B1 * | 1/2019 | Samples | B67D 3/0029 |

(Continued)

*Primary Examiner* — Peter N Helvey

(57) ABSTRACT

A portable food cooler apparatus comprises a box portion having an exterior surface and an interior surface. The interior surface of the box portion defines a food cavity having an open top. A lid may be pivotably mounted to the box portion and is operable between an open position and a closed position. At least one accessory mounting rail is attached to the exterior surface of the box portion of the cooler. One or more accessories, each having at least one rail mounting assembly, is removably attachable to the rail. The accessories, for example, may include one of a rod holder, wheel assembly, cradle or strut.

14 Claims, 36 Drawing Sheets

(56) References Cited

U.S. PATENT DOCUMENTS

| | | | | |
|---|---|---|---|---|
| 2007/0051031 | A1* | 3/2007 | Allen | A01K 97/05<br>43/54.1 |
| 2007/0119093 | A1* | 5/2007 | Jaskulski | A01K 97/06<br>43/54.1 |
| 2015/0150231 | A1* | 6/2015 | Norman | A01K 97/08<br>43/17.5 |
| 2016/0120162 | A1* | 5/2016 | Copper | A01K 97/04<br>43/56 |
| 2018/0141718 | A1* | 5/2018 | Ahlstrom | A45F 3/46 |

* cited by examiner

PORTABLE COOLER WITH ACCESSORY ATTACHMENT RAILS

CROSS-REFERENCE TO RELATED APPLICATIONS

This application claims the benefit of U.S. Provisional Application No. 62/370,534 filed on Aug. 3, 2016, which provisional application is hereby incorporated by reference in its entirety.

STATEMENT REGARDING FEDERALLY SPONSORED RESEARCH OR DEVELOPMENT

Not Applicable.

BACKGROUND OF THE INVENTION

1. The Field of the Invention

The present invention relates generally to portable food coolers and more particularly, but not necessarily entirely, to portable food coolers having means for attaching modular accessories.

2. Description of Related Art

A portable food cooler typically comprises a box portion that defines a cavity for receiving food and beverages. In particular, the box portion may comprise four sidewalls and a bottom. A topmost perimeter of the four sidewalls defines an opening that provides access to the food cavity. Further, the walls of the box portion are insulated walls that prevent heat transfer. The cooler may further include a lid operable between an open position and a closed position. In the open position, items may be placed into the food cavity through the opening defined by the top perimeter of the four sidewalls. In the closed position, the lid seals the cavity in a substantially airtight manner.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1B:
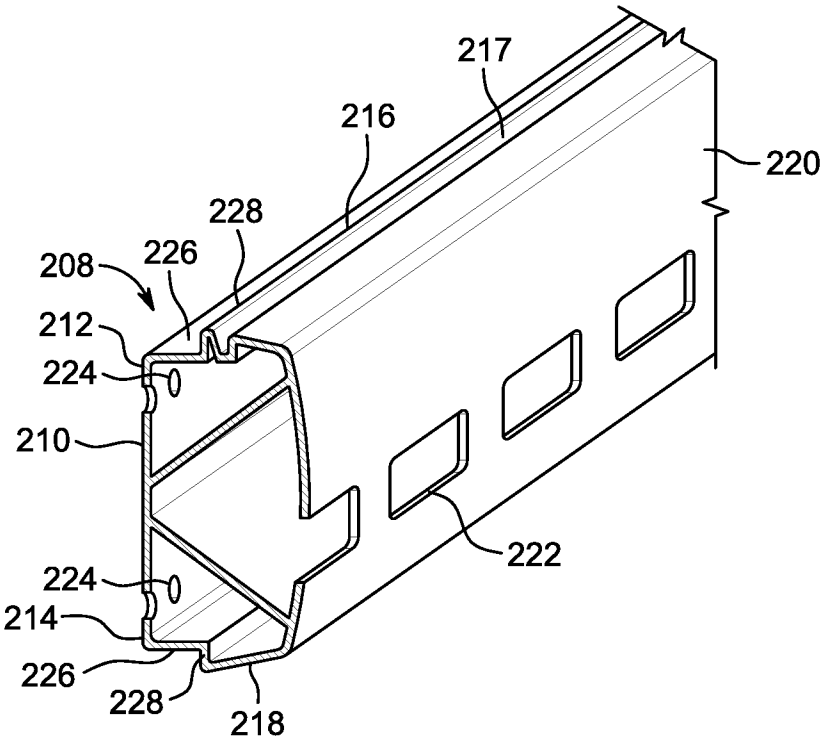
FIG. 1B is a fragmentary view of an accessory mounting rail used on the portable cooler shown in FIG. 1A.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. As used in this specification and the appended claims, the singular forms "a," "an," and "the" include plural referents unless the context clearly dictates otherwise. As used herein, the terms "comprising," "including," "containing," "characterized by," "having," and grammatical equivalents thereof are inclusive or open-ended terms that do not exclude additional, unrecited elements or method steps.

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

It is an objective of the present disclosure to provide a portable food cooler having a box portion and a lid. Disposed on an outer surface of the cooler is a plurality of accessory mounting rails. In an embodiment, the accessory mounting rails are disposed on at least one side of the cooler. In an embodiment, the accessory mounting rails are disposed on all four sides of the cooler. In an embodiment, the accessory mounting rails comprises a first set of rails and a second set of rails—the first set of rails extending along a top perimeter of the box portion of the cooler and the second set of rails extending along a bottom perimeter of the box portion of the cooler.

It is further an objective of the present disclosure to provide a plurality of accessory mounting rails for use on a portable cooler. Accessories may be attached to the accessory mounting rails using mounting assemblies. In an embodiment, the modular accessories attachable to the rails may include rod holders, umbrellas, canopies, shade covers, tables, cutting boards, wheels, storage containers, pouches, bags, drink holders, leveling struts, extendable legs, handles, and a cradle system. Other types of accessories may be attached to the accessory mounting rails as well.

It is further an objective of the present disclosure to provide a portable cooler having seats or benches that can be attached to the lid of the cooler. In an embodiment, the seats or benches include downward projections that are configured and adapted to engage cup holders formed in the lid.

It is further an objective of the present disclosure to provide a portable cooler having an attachable sound system. In an embodiment, the sound system includes a housing that attaches to the lid of the cooler. The speaker housing may be attached using clasps. Disposed within the housing may be speakers.

Figure 8:
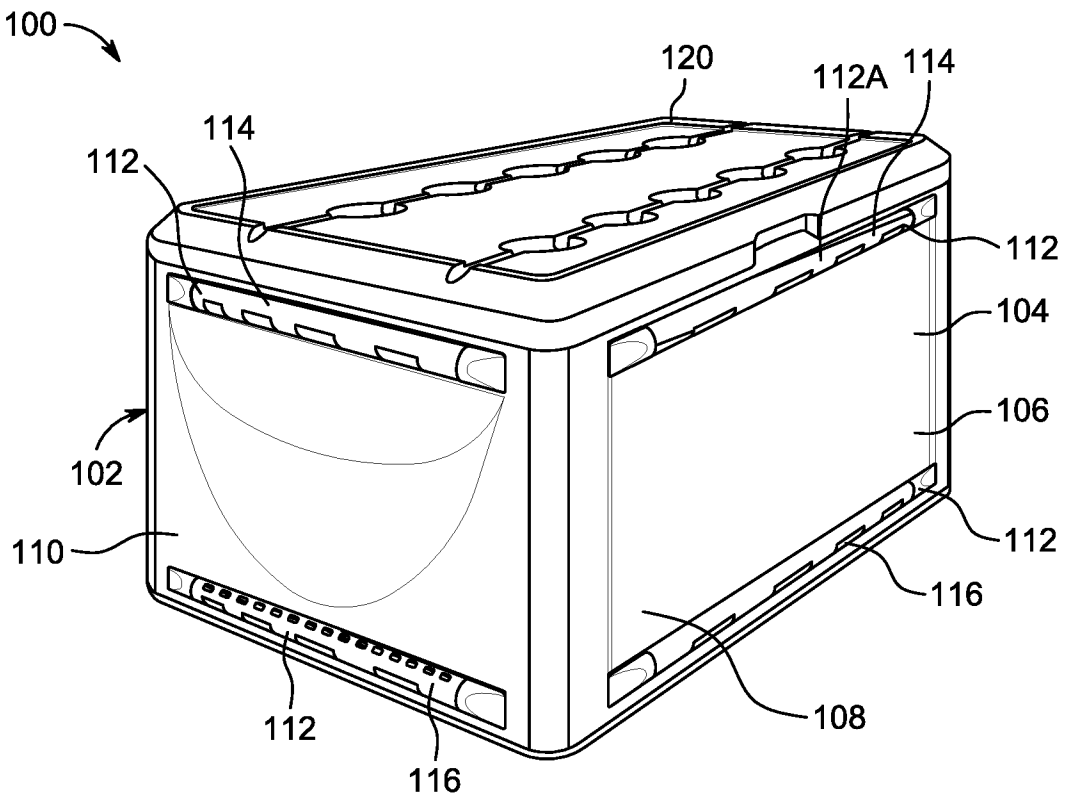
FIG. 8 is a perspective view of a portable cooler with accessory mounting rails according to an embodiment of the present disclosure.

Referring first to FIG. 8, there is depicted a portable cooler 100 according to an embodiment of the present disclosure. The cooler 100 includes a box portion 102 defined by a shell 104 with an exterior surface 106 and an interior surface (not visible). Disposed between the exterior surface 106 and the interior surface is an insulating material in order to keep the contents of the cooler 100 at a desired temperature as is known to one of ordinary skill. For example, in an embodiment, cubed or block ice may be placed into the interior of the cooler 100 as is known to one having ordinary skill.

The box portion 102 may include four sidewalls including a front 108, a back (not visible), a first side 110, and a second side (not visible). Disposed on the four sides of the box portion 102 are accessory mounting rails 112. In particular, the rails 112 include a top set of accessory mounting rails 114 and a bottom set of accessory mounting rails 116.

Disposed on the top of the box portion 102 of the cooler 100 is a lid 120 that is pivotably attached such that the lid 120 is operable between an open position and a closed position. When the lid 120 is operated to the open position, the interior cavity of the box portion 102 is accessible such that food items and ice can be placed within the cooler 100. With the lid 120 in the closed position as shown in FIG. 8, the interior cavity of the box portion 102 is sealed in a substantially airtight manner.

Figure 9B:
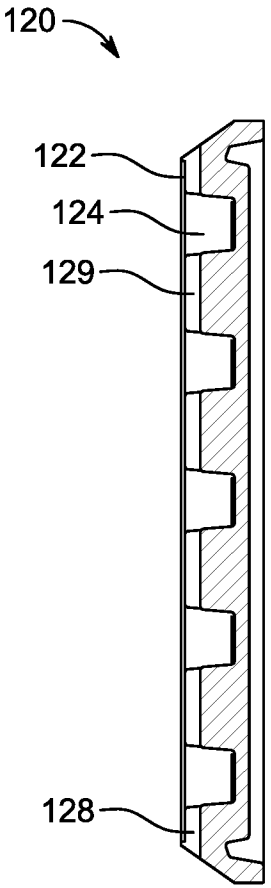
FIG. 9B is a cross-sectional view of the cooler lid shown in FIG. 9A.
Figure 9A:
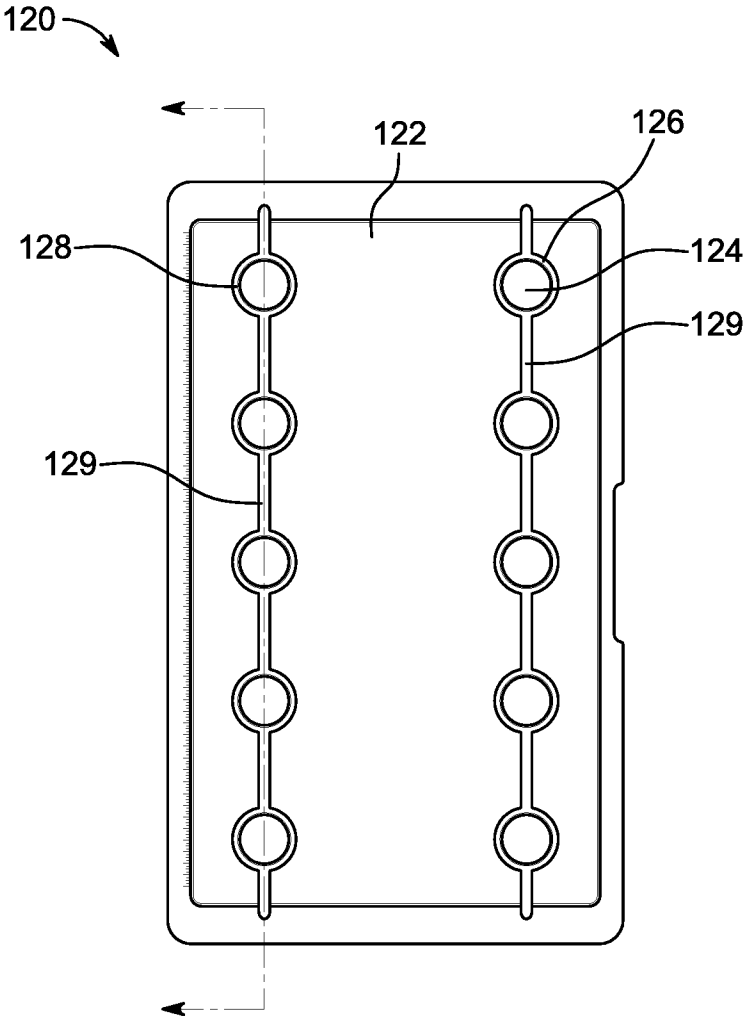
FIG. 9A is top view of a cooler lid with cup holders according to an embodiment of the present disclosure.

Referring to FIGS. 9A and 9B, formed in a top surface 122 of the lid 120 are a plurality of cup holders 124. The cup holders 124 may be arranged in a first row 126 and a second row 128. Extending along each of the rows 126 and 128 of each of the cup holders 124 is a drip channel 129. It will be appreciated that the drip channel 129 is operable to drain water from the top surface 122.

Figure 9D:
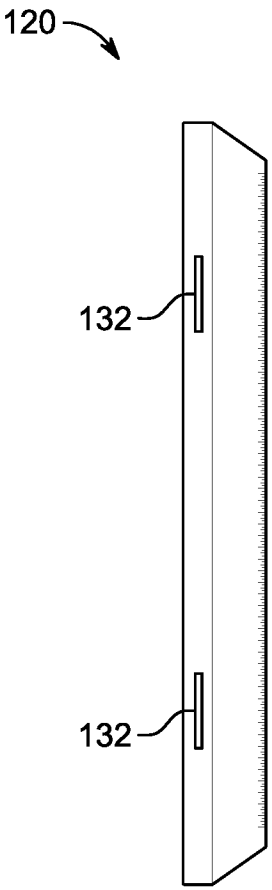
FIG. 9D is a rear view of the cooler lid shown in FIG. 9A.
Figure 9C:
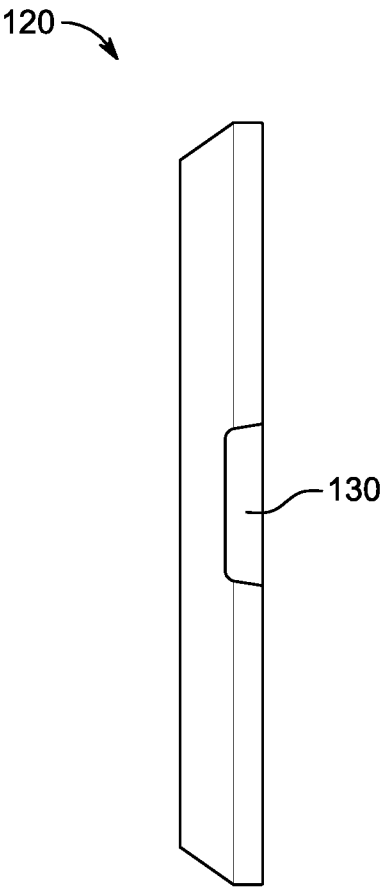
FIG. 9C is a front view of the cooler lid shown in FIG. 9A.

Referring to FIG. 9C, formed in a front of the lid 120 is a handle 130. As shown in FIG. 9D, a pair of slots 132 is formed in the rear of the lid 120. The slots 132 are configured and adapted to receive a hinge that allows the lid 120 to be connected to the cooler 100.

Referring now back to FIG. 8, the rails 112 allow accessories to be removably attached to the cooler 100. In an embodiment, the rails 112 are formed from a metal, such as aluminum. In an embodiment, the rails 112 are formed from extruded aluminum. The rails 112 may be secured to the cooler 100 in a variety of manners. In an embodiment, the rails 112 may be secured using fasteners. In an embodiment, the exterior surface 106 of the box portion 102 may include molded channels for receiving the rails 112. In an embodiment, the rails 112 may be secured to the cooler 100 using brackets. In whatever manner the rails 112 are attached to the cooler 100, the rails 112 should be firmly and securely attached.

In an embodiment, the rails 112 include a receiving surface 112A for receiving an accessory mounting assembly. The accessory mounting assembly allows desirable accessories to be temporality secured to the rails 112 of the cooler 100 at desired locations. It will be appreciated that the accessory mounting assemblies include a locking feature for locking the accessories onto the rails 112. In an embodiment, the accessory mounting assemblies include, without limitation, one or more of a clamp, locking pin, key, cam, lock, to attach to the rails 112. The mounting assemblies further include a release such that the accessories can be removed from the rails 112. The release may include a hand-operated lever. In this regard, the mounting assemblies may include a clamp for facilitating attachment to the rails 112. In an embodiment, the mounting assemblies may include a spring loaded, retractable pin for facilitating attachment to the rails 112.

Figure 1A:
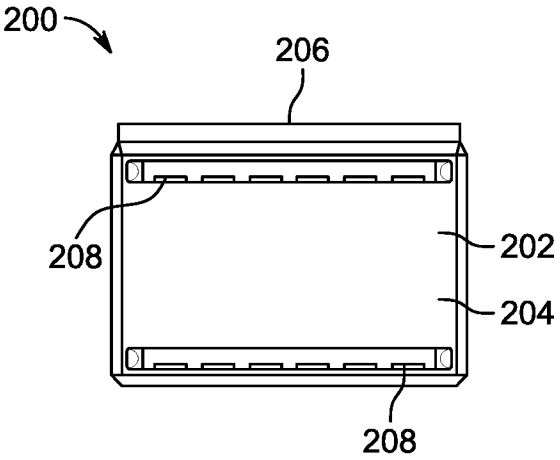
FIG. 1A is a front view of a portable cooler with accessory mounting rails according to an embodiment of the present disclosure.

Referring now to FIG. 1A, there is depicted a portable cooler 200 according to an embodiment of the present disclosure. The cooler 200 includes a box portion 202 having four sides, including a front side 204. A lid 206 is disposed on the top of the box portion 202 and is operable between an open position and a closed position as is known to one having ordinary skill in the art. With the lid 206 operated to the open position, food items may be placed inside of the cooler 200. With the lid 206 operated to the closed position, the box portion 202 may be substantially airtight. Disposed on at least one of the sides of the box portion 202 are accessory mounting rails 208 as shown in FIG. 1A. The accessory mounting rails 208 allow accessories to be attached to the cooler 200.

Referring to FIG. 1B, the accessory mounting rail 208 may extend along a longitudinal axis and may have a generally tubular shape. In this regard, the rail 208 comprises a back wall 210 extending between a top edge 212 and a bottom edge 214. Extending forwardly from the top edge 212 of the back wall 210 is a top sidewall 216. Extending forwardly from the bottom edge 214 of the back wall 210 is a bottom sidewall 218. The rail 208 may further comprise a front wall 220 spaced apart from the back wall 210 and extending between the top sidewall 216 and the bottom sidewall 218. The front wall 220 may comprise a series of accessory mounting slots 222 arranged a row. It will be appreciated that the slots 222 provide a plurality of user selectable mounting locations for accessories as will be described in more detail below. In an embodiment, the back wall 210 of the rail 208 may include a plurality of bores 224. The bores 224 are used in combination with fasteners to secure the rail 208 to the cooler 200. A rear portion of the rail 208 may define a male portion 226 that ends at stops 228. Further, formed in the top sidewall 216 may be a locking channel 217.

Figure 1D:
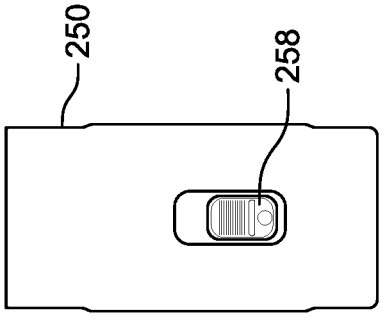
FIG. 1D is a front view of a mounting assembly for attaching accessories to the accessory mounting rails shown in FIG. 1A.
Figure 1C:
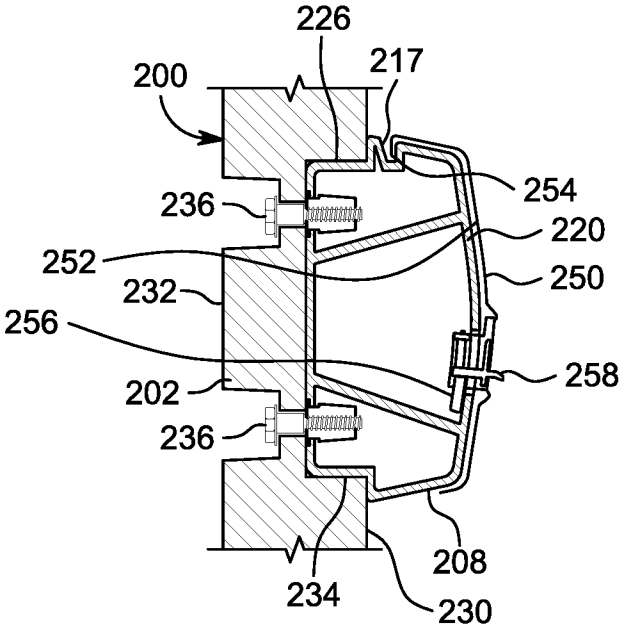
FIG. 1C is a cross-sectional view of the accessory mounting rail shown in FIG. 1B mounted onto the portable cooler shown in FIG. 1A.

Referring to FIG. 1C, an exterior surface 230 of the box portion 202 of the cooler 200 may have at least one channel 234 formed therein for receiving the male portion 226 of the rail 208. Fasteners 236 may be installed from an interior surface 232 of the box portion 202 in order to secure the rail 208 to the exterior surface 230 and, in particular, in the channel 234. In an embodiment, the fasteners 236 may comprise bolts and nuts.

Referring to FIGS. 1C and 1D, the rail 208 is configured and adapted to receive a mounting assembly 250. An inner surface 252 of the mounting assembly 250 is adapted to engage the front wall 220 of the rail 208. In addition, a top end 254 of the mounting assembly 250 is configured to engage the locking channel 217 formed in the top of the rail 208. The mounting assembly 250 may further include a spring-loaded locking pin 256. The locking pin 256 is biased to a locked position by a spring (not explicitly shown). A lever 258 allows a user to operate the locking pin 256 to an unlocked position. With the locking pin 256 moved to the unlocked position, the pin 256 may be installed into one of the slots 222 formed on the front surface 220 of the rail 208. When the pin 256 is released, it extends to thereby secure the mounting assembly 250 onto the rail. As will be explained hereinafter, the mounting assembly 250 may be utilized to attach accessories to the cooler 200.

Figure 2B:
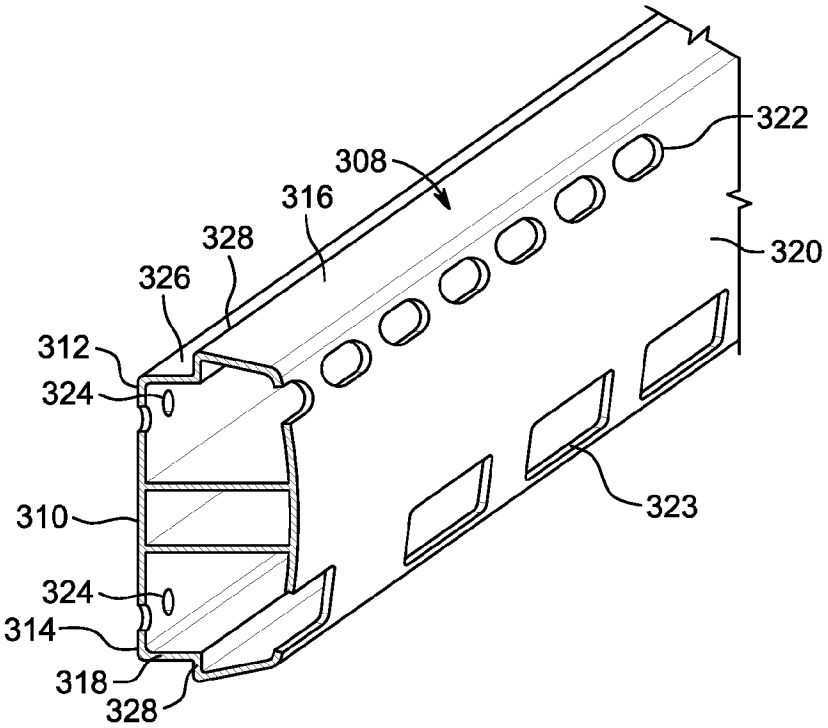
FIG. 2B is a fragmentary view of an accessory mounting rail used on the portable cooler shown in FIG. 2A.
Figure 2A:
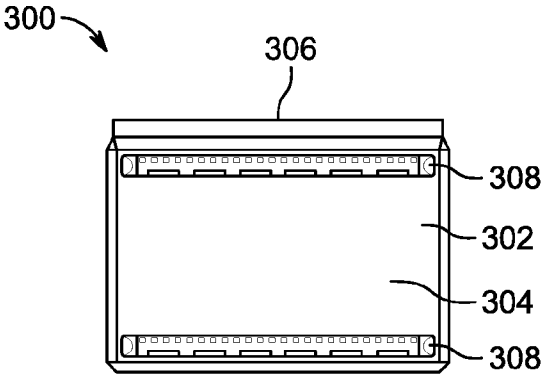
FIG. 2A is a front view of a portable cooler with accessory mounting rails according to an embodiment of the present disclosure.

Referring now to FIG. 2A, there is depicted a portable cooler 300 according to an embodiment of the present disclosure. The cooler 300 includes a box portion 302 having four sides, including a front side 304. A lid 306 is disposed on the top of the box portion 302 and is operable between an open position and a closed position as is known to one having ordinary skill in the art. With the lid 306 operated to the open position, food items may be placed inside of the cooler 300. With the lid 306 operated to the closed position, the box portion 302 may be substantially airtight. Disposed on at least one of the sides of the box portion 302 are accessory mounting rails 308 as shown in FIG. 2A. The accessory mounting rails 308 allow accessories to be attached to the cooler 300.

Referring to FIG. 2B, the accessory mounting rail 308 may extend along a longitudinal axis and may have a generally tubular shape. In this regard, the rail 308 comprises a back wall 310 extending between a top edge 312 and a bottom edge 314. Extending forwardly from the top edge 312 of the back wall 310 is a top sidewall 316. Extending forwardly from the bottom edge 314 of the back wall 310 is a bottom sidewall 318. The rail 308 may further comprise a front wall 320 spaced apart from the back wall 310 and extending between the top sidewall 316 and the bottom sidewall 318. The front wall 320 may comprise a first row of accessory mounting slots 322 and a second row of accessory mounting slots 323. It will be appreciated that the slots 322 and 323 provide a plurality of user selectable mounting locations for accessories as will be described in more detail below. In an embodiment, the slots 322 are smaller than the slots 323.

In an embodiment, the back wall 310 of the rail 308 may include a plurality of bores 324. The bores 324 are used in combination with fasteners to secure the rail 308 to the cooler 300. A rear portion of the rail 308 may define a male portion 326 that ends at stops 328.

Figure 2D:
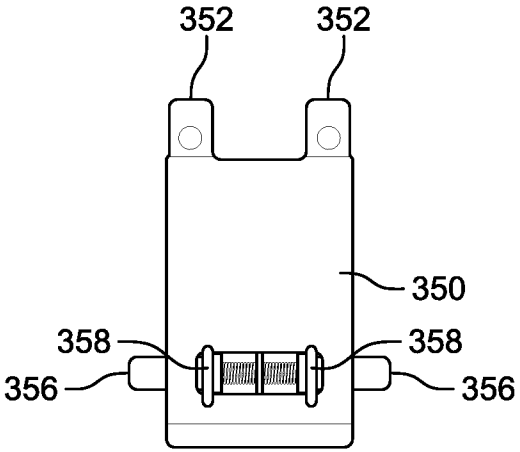
FIG. 2D is a front view of a mounting assembly for attaching accessories to the accessory mounting rails shown in FIG. 2A.
Figure 2C:
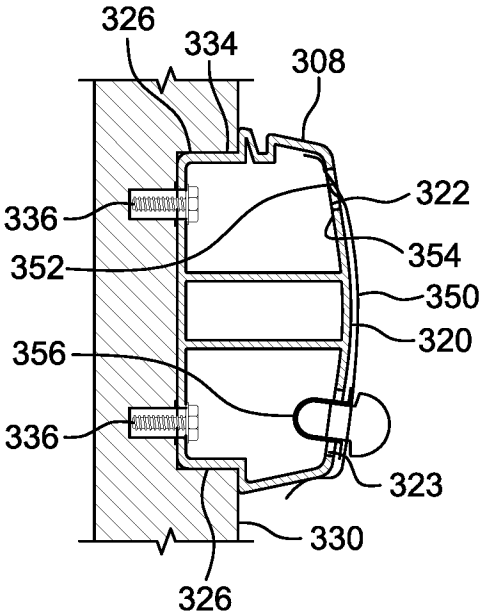
FIG. 2C is a cross-sectional view of the accessory mounting rail shown in FIG. 2B mounted onto the portable cooler shown in FIG. 2A.

Referring to FIG. 2C, an exterior surface 330 of the box portion 302 of the cooler 300 may have at least one channel 334 formed therein for receiving the male portion 326 of the rail 308. Fasteners 336 may be installed in order to secure the rail 308 to the exterior surface 330 and, in particular, in the channel 334.

Referring to FIGS. 2B, 2C and 2D, the rail 308 is configured and adapted to receive a mounting assembly 350. The mounting assembly 350 comprises a pair of mounting tabs 352 that are configured and dimensioned to be installed into a pair of the slots 322. An inner surface 354 of the mounting assembly 350 is adapted to engage the front wall 320 of the rail 308. The mounting assembly 350 may further include spring-loaded locking pins 356. The locking pins 356 are biased to a locked position by a spring (not explicitly shown). A lever 358 allows a user to operate the locking pins 356 to an unlocked position. With the locking pins 356 moved to the unlocked position, the pins 356 may be installed into one of the slots 323 formed on the front surface 320 of the rail 308. When the pins 356 are released, they extend to thereby secure the mounting assembly 350 onto the rail 308. As will be explained hereinafter, the mounting assembly 350 may be utilized to attach accessories to the cooler 300.

Figure 3B:
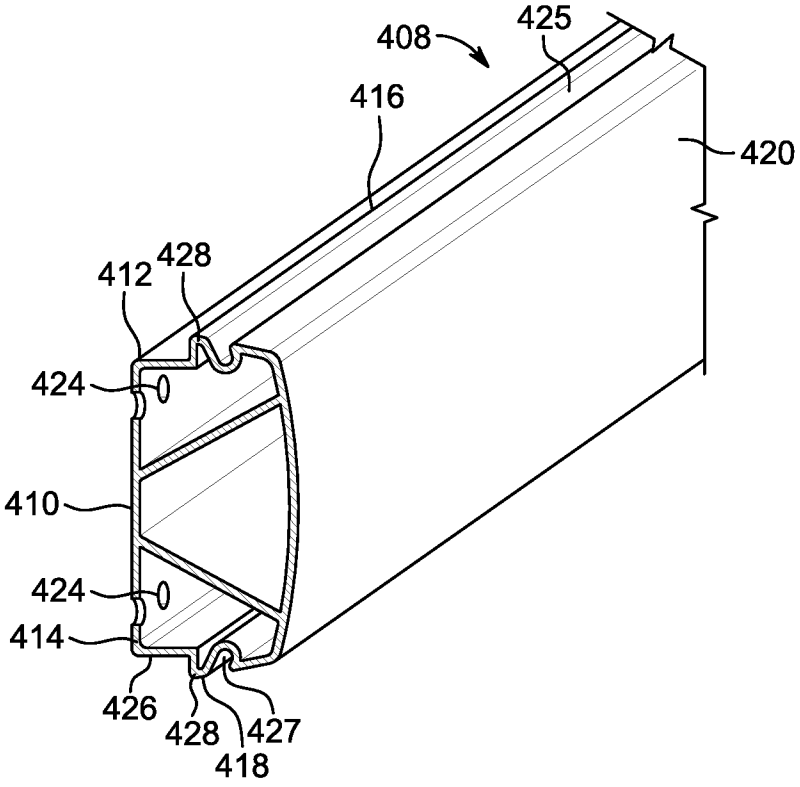
FIG. 3B is a fragmentary view of an accessory mounting rail used on the portable cooler shown in FIG. 3A.
Figure 3A:
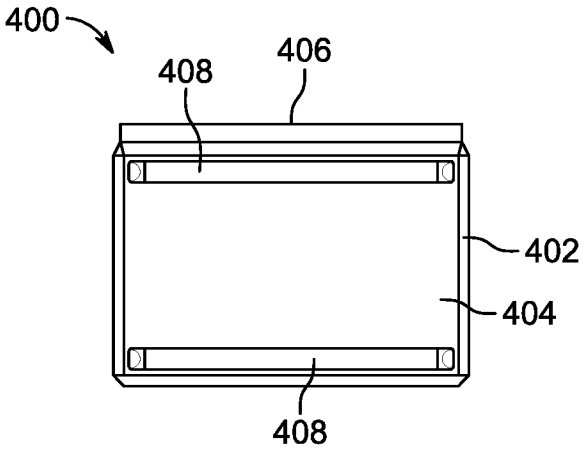
FIG. 3A is a front view of a portable cooler with accessory mounting rails according to an embodiment of the present disclosure.

Referring now to FIG. 3A, there is depicted a portable cooler 400 according to an embodiment of the present disclosure. The cooler 400 includes a box portion 402 having four sides, including a front side 404. A lid 406 is disposed on the top of the box portion 402 and is operable between an open position and a closed position as is known to one having ordinary skill in the art. With the lid 406 operated to the open position, food items may be placed inside of the cooler 400. With the lid 406 operated to the closed position as shown in FIG. 3A, the interior of the box portion 402 may be substantially airtight. Disposed on at least one of the sides of the box portion 402 are accessory mounting rails 408 as shown in FIG. 3A. The accessory mounting rails 408 allow accessories to be attached to the cooler 400.

Referring to FIG. 3B, the accessory mounting rail 408 may extend along a longitudinal axis and may have a generally tubular shape. In this regard, the rail 408 comprises a back wall 410 extending between a top edge 412 and a bottom edge 414. Extending forwardly from the top edge 412 of the back wall 410 is a top sidewall 416. Extending forwardly from the bottom edge 414 of the back wall 410 is a bottom sidewall 418. The rail 408 may further comprise a front wall 420 spaced apart from the back wall 410 and extending between the top sidewall 416 and the bottom sidewall 418.

In an embodiment, the back wall 410 of the rail 408 may include a plurality of bores 424. The bores 424 are used in combination with fasteners to secure the rail 408 to the cooler 400. A rear portion of the rail 408 may define a male portion 426 that ends at stops 428. The rail 408 may further comprise a top locking channel 425 and a bottom locking channel 427.

Figure 3D:
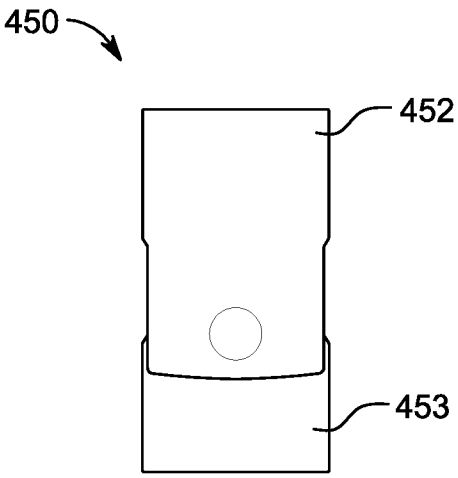
FIG. 3D is a front view of a mounting assembly for attaching accessories to the accessory mounting rail shown in FIG. 3*b;*
Figure 3C:
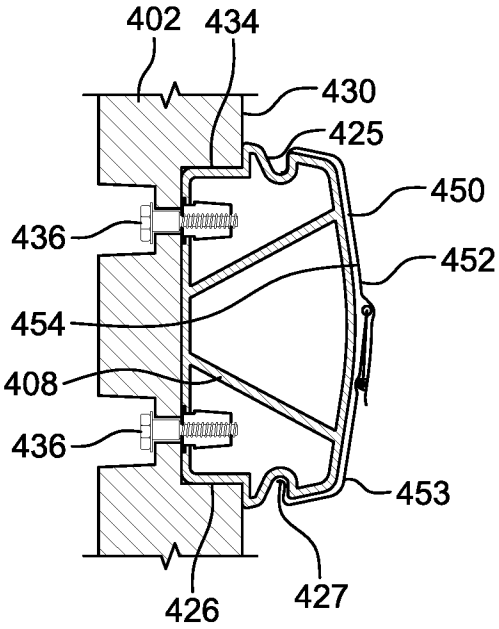
FIG. 3C is a cross-sectional view of the accessory mounting rail shown in FIG. 3B mounted onto the portable cooler shown in FIG. 3A.

Referring to FIG. 3C, an exterior surface 430 of the box portion 402 of the cooler 400 may have at least one channel 434 formed therein for receiving the male portion 426 of the rail 408. Fasteners 436 may be installed in order to secure the rail 408 to the exterior surface 430 and, in particular, in the channel 434.

Referring to FIGS. 3C and 3D, the rail 408 is configured and adapted to receive a mounting assembly 450. The mounting assembly 450 comprises a top portion 452 and a bottom portion 453. An inner surface 454 of the mounting assembly 450 is adapted to engage the front wall 420 of the rail 408. The top portion 452 may comprise a lip configured and adapted to engage the locking channel 425. The bottom portion 453 may comprise a lip configured and adapted to engage the locking channel 427. It will be appreciated that the top portion 452 and the bottom portion 453 of the mounting assembly 450 clamp onto the rail 408 using an over-the-center, cam-locking feature (this could be spring assisted or hasp-like locking detail).

Figure 4B:
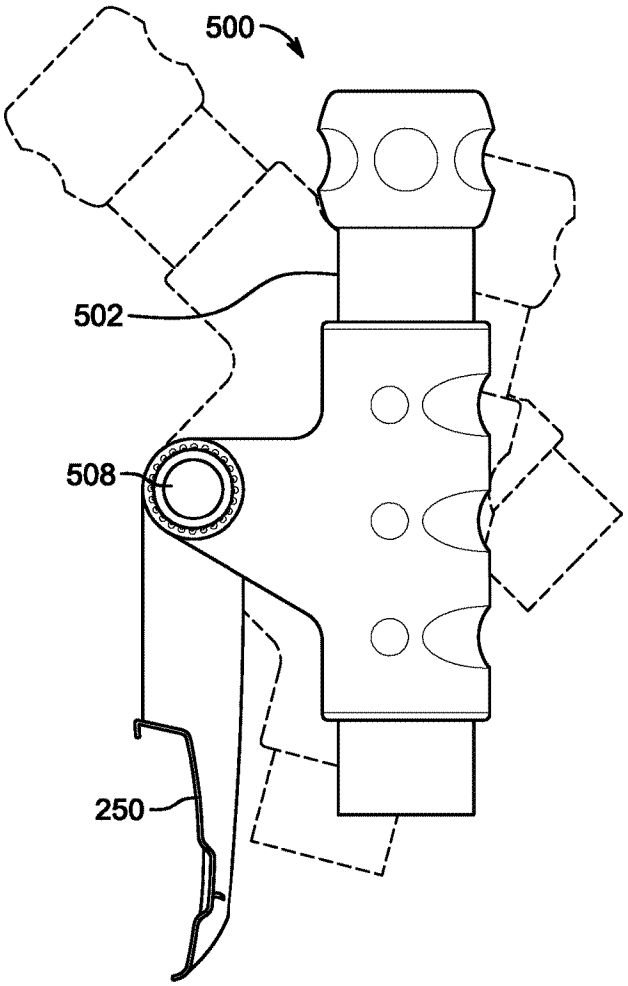
FIG. 4B depicts various angled positions of the accessory shown in FIG. 4A.
Figure 4A:
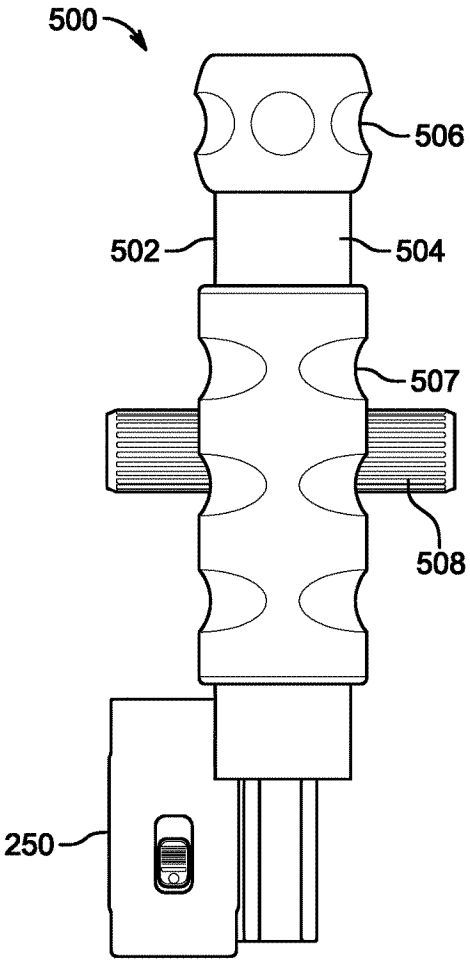
FIG. 4A is a front view of accessory with a mounting assembly for attaching the accessory to an accessory mounting rail on a portable cooler.
Figure 4C:
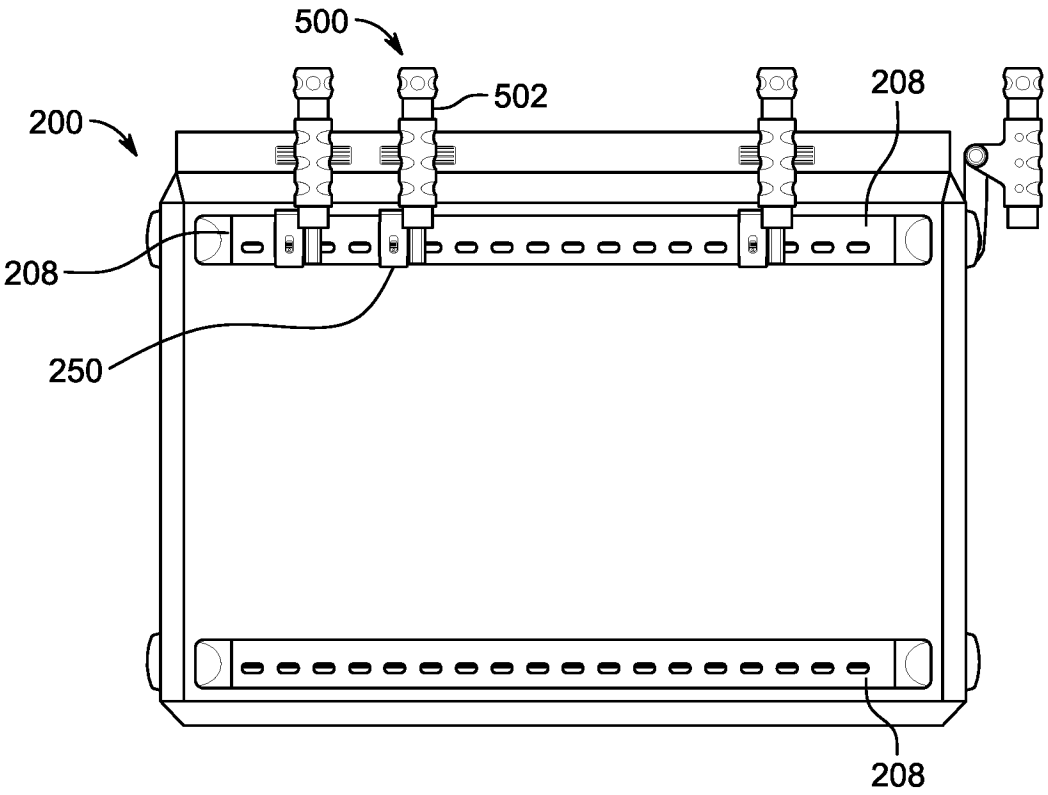
FIG. 4C is a front view of a portable cooler with accessories mounted to its accessory mounting rails.

Referring now to FIGS. 4A-4C, there is depicted the cooler 200 as shown in FIGS. 1A-1C, where like reference numerals depict like components. Attached to the rails 208 are accessories 500. Each of the accessories 500 includes a mounting assembly 250 for attaching the accessory 500 to the rails 208 as previously described above. In an embodiment, the accessory 500 may take the form of a fishing rod holder 502 has shown in FIGS. 4A-4C. In an embodiment, the accessory 500 may take the form of any useful apparatus.

In an embodiment, the rod holder 502 may include an aluminum tube 504 for receiving a handle of a fishing pole (not shown). The rod holder 502 may include a friction cone 506 for securing the fishing pole handle in the tube 504 through a twist lock operation. The rod holder 502 may further include an overwrap handle 507 that is installed on an outer surface of the tube 504. The rod holder 502 may further comprise a pivot joint 508 that allows the tube 504 to be adjustable at various angles as shown in FIG. 4B. It will be appreciated that while the accessories 500 are depicted using the mounting assemblies 250, that the other mounting assemblies 350 and 450 may be utilized, with the appropriate rails.

Figure 5A:
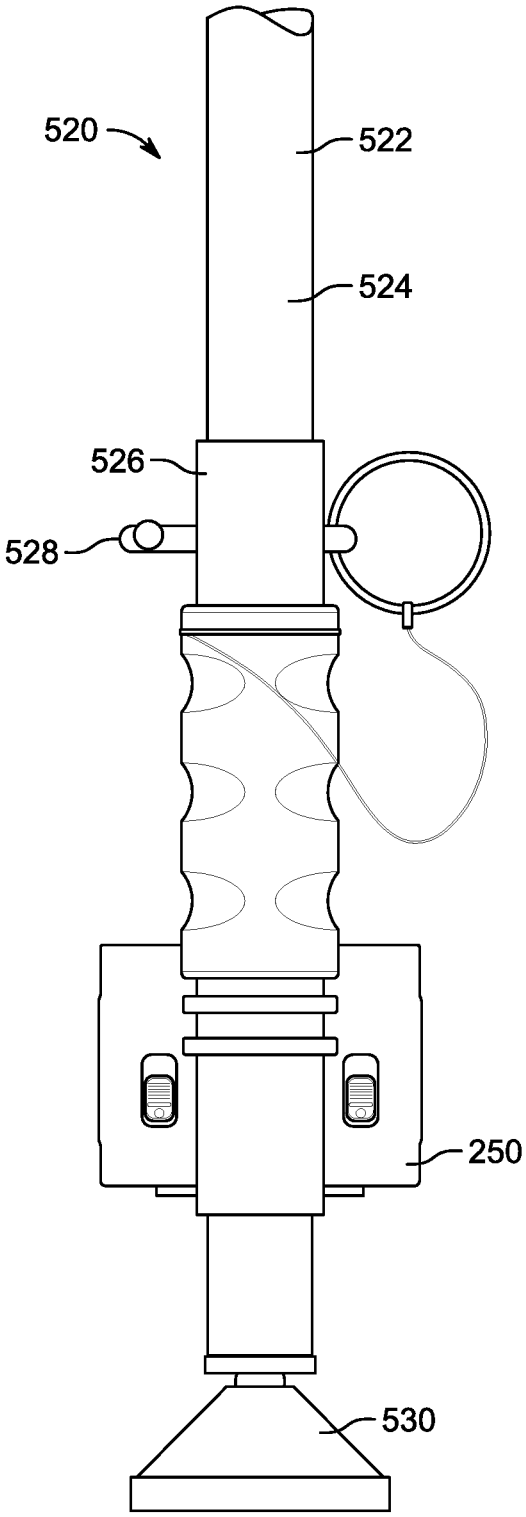
FIG. 5A is a front view of an accessory with a mounting assembly for attaching the accessory to an accessory mounting rail on a portable cooler.
Figure 5B:
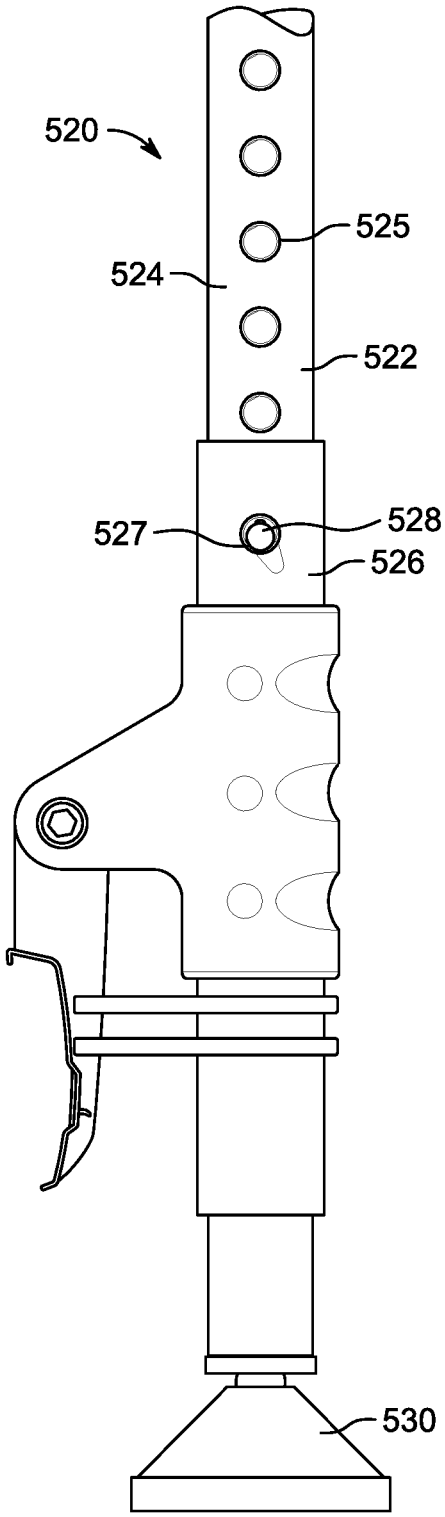
FIG. 5B is a side view of the accessory shown in FIG. 5A.
Figure 5C:
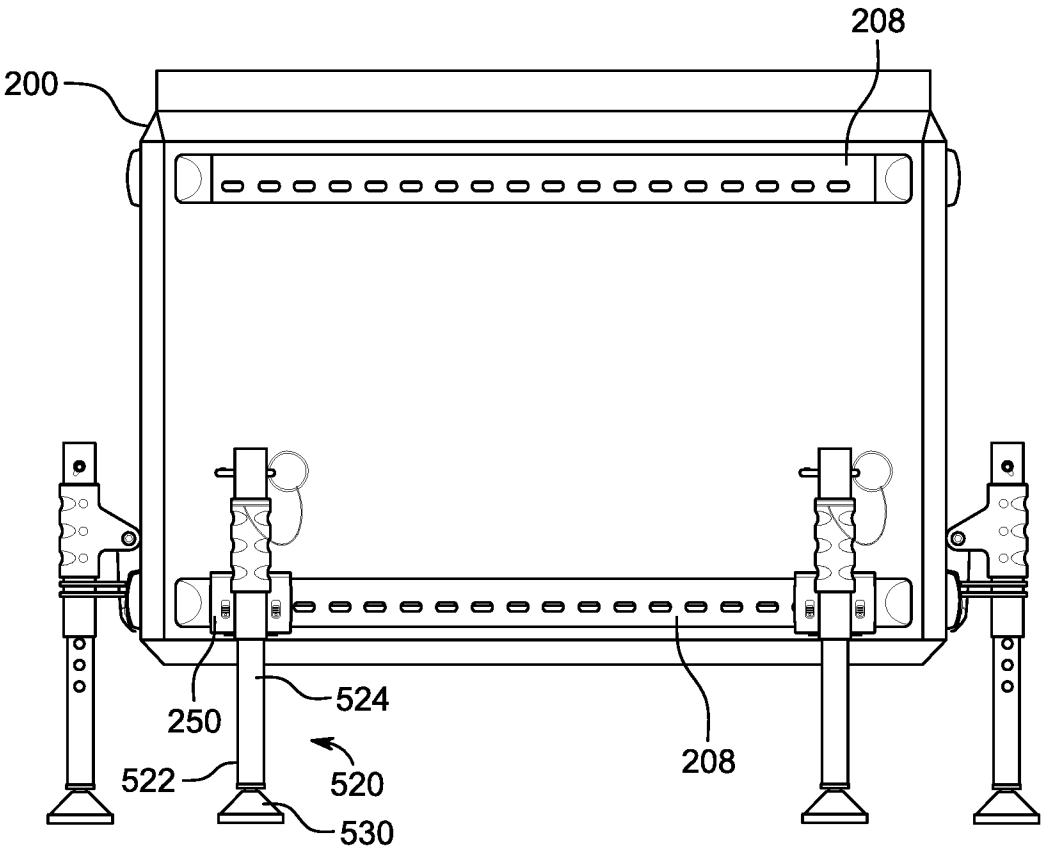
FIG. 5C is a front view of a portable cooler with multiple accessories mounted to its accessory mounting rails.

Referring now to FIGS. 5A-5C, there is depicted the cooler 200 as shown in FIGS. 1A-1C, where like reference numerals depict like components. Attached to the rails 208 are accessories 520. Each of the accessories 520 includes a pair of mounting assemblies 250 for attaching the accessory 520 to the rails 208 as previously described above. In an embodiment, the accessories 520 may take the form of extension legs 522.

In an embodiment, the extension legs 522 may comprise an inner leg 524 that extends through an outer tube 526. The outer tube 526 may be fixed to the mounting assemblies 250. An extension distance of the inner leg 524 may be adjustable with respect to the outer tube 526. The inner leg 524 is locked into place using a pin 528. In particular, the pin 528 may be selectably installed into one of a plurality of bores 525 on the inner leg 524 and through a master bore 527 formed in the outer tube 526. Disposed on a lower end of the inner leg 524 is a swivel foot 530. It will be appreciated that the swivel foot 530 allows the cooler 200 to be placed level on uneven surfaces. It will be further appreciated that multiple extension leg accessories 520 may be mounted onto the rails 208.

Figure 6A:
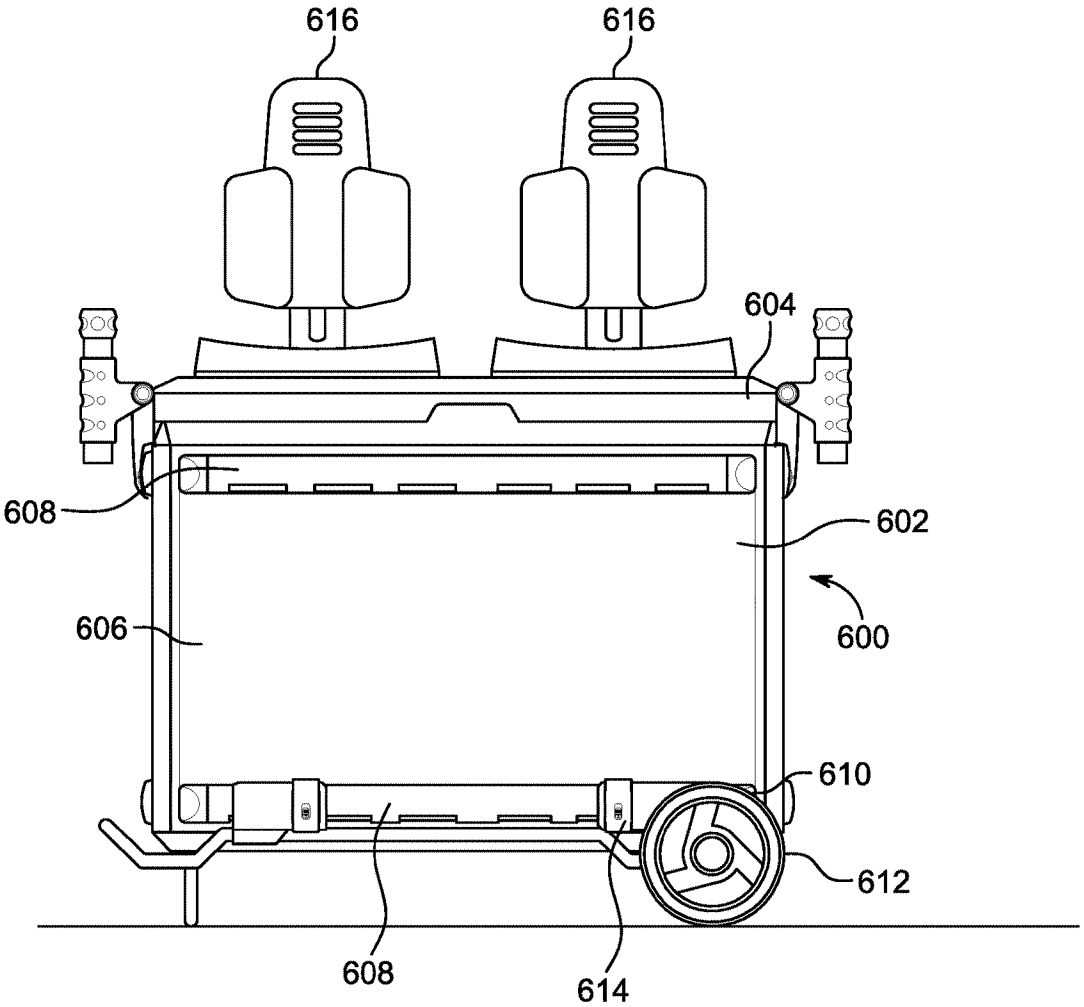
FIG. 6A is a front view of a portable cooler with a pair of seat accessories mounted to the lid of the cooler.
Figure 6B:
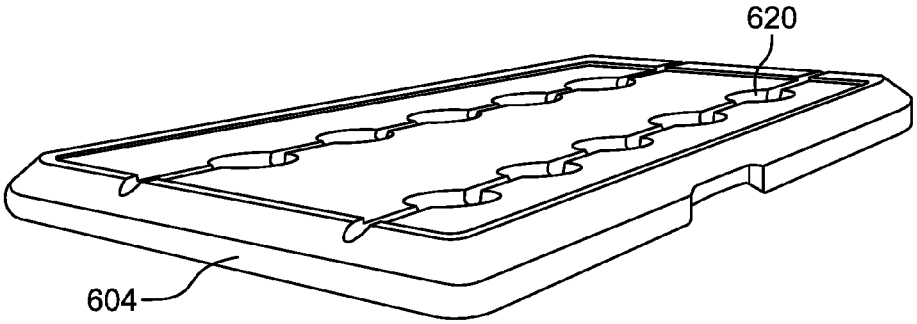
FIG. 6B is a perspective view of a cooler lid.
Figure 6C:
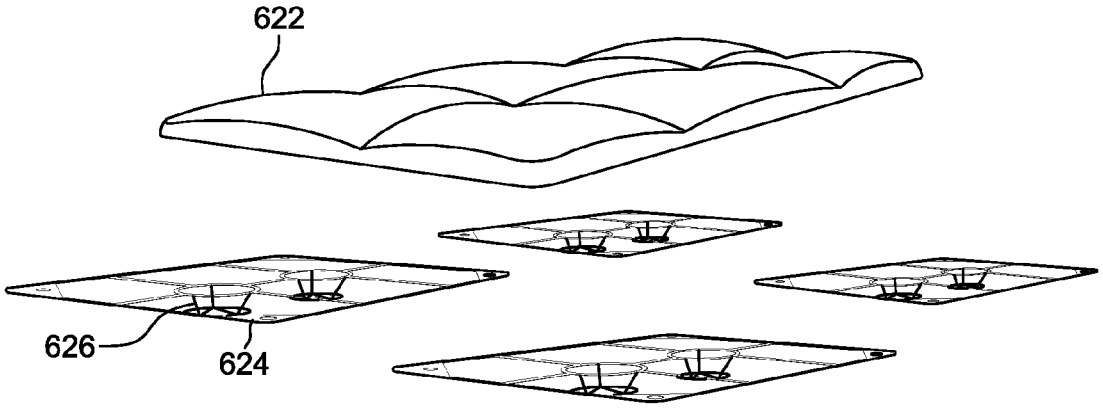
FIG. 6C is an exploded view of a bench seat assembly that attaches to the cooler lid.
Figure 6D:
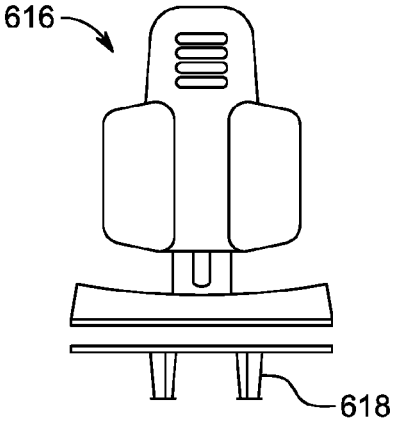
FIG. 6D is an exploded view of a seat assembly that attaches to the cooler lid.
Figure 7B:
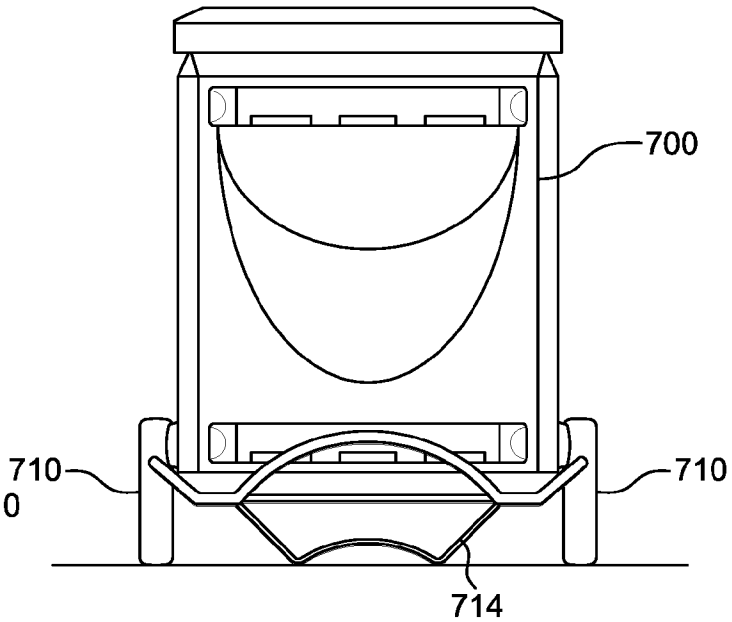
FIG. 7B is a side view of the portable cooler shown in FIG. 7A.
Figure 7A:
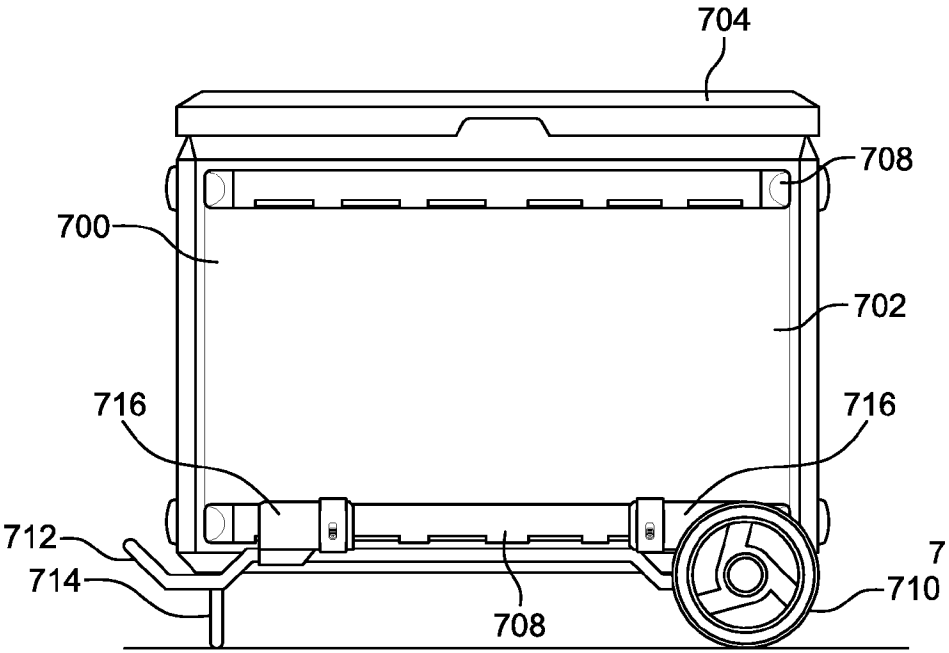
FIG. 7A is a front view of a portable cooler with modular wheel assemblies.
Figure 7D:
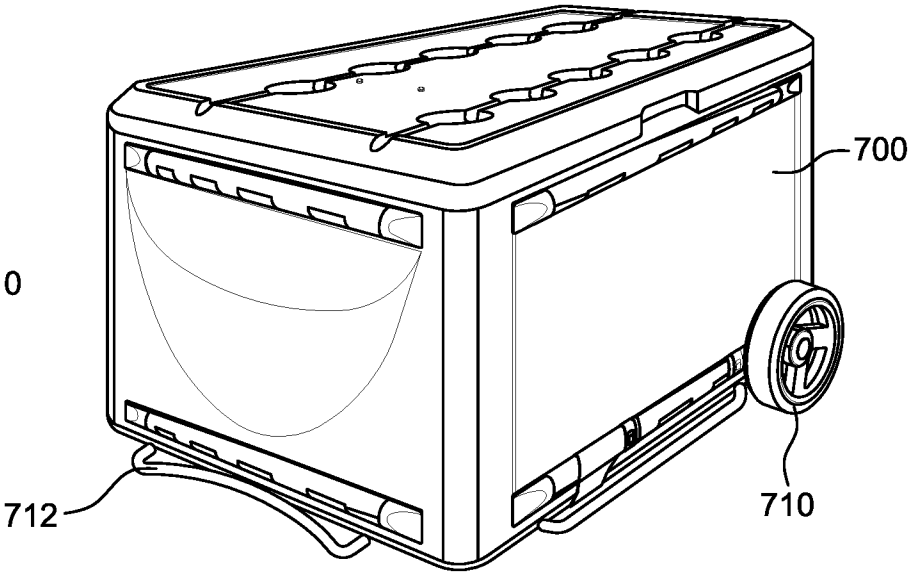
FIG. 7D is a perspective view of the portable cooler shown in FIG. 7A.
Figure 7C:
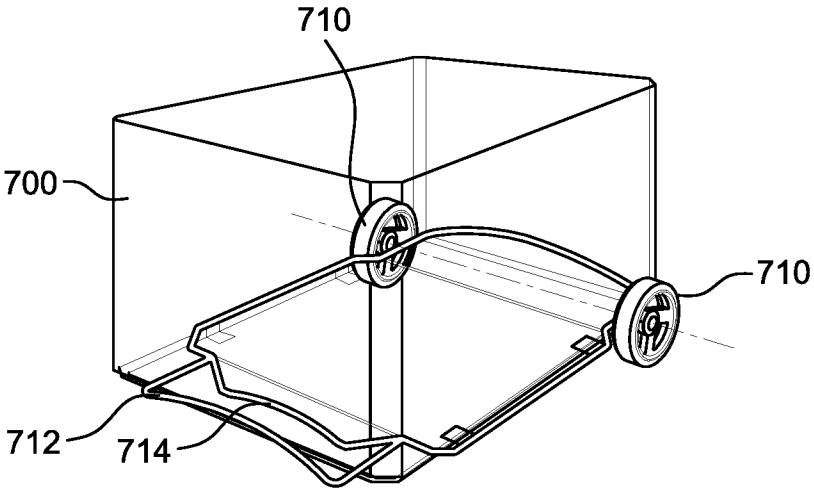
FIG. 7C is a perspective view of the portable cooler shown in FIG. 7A.
Figure 7E:
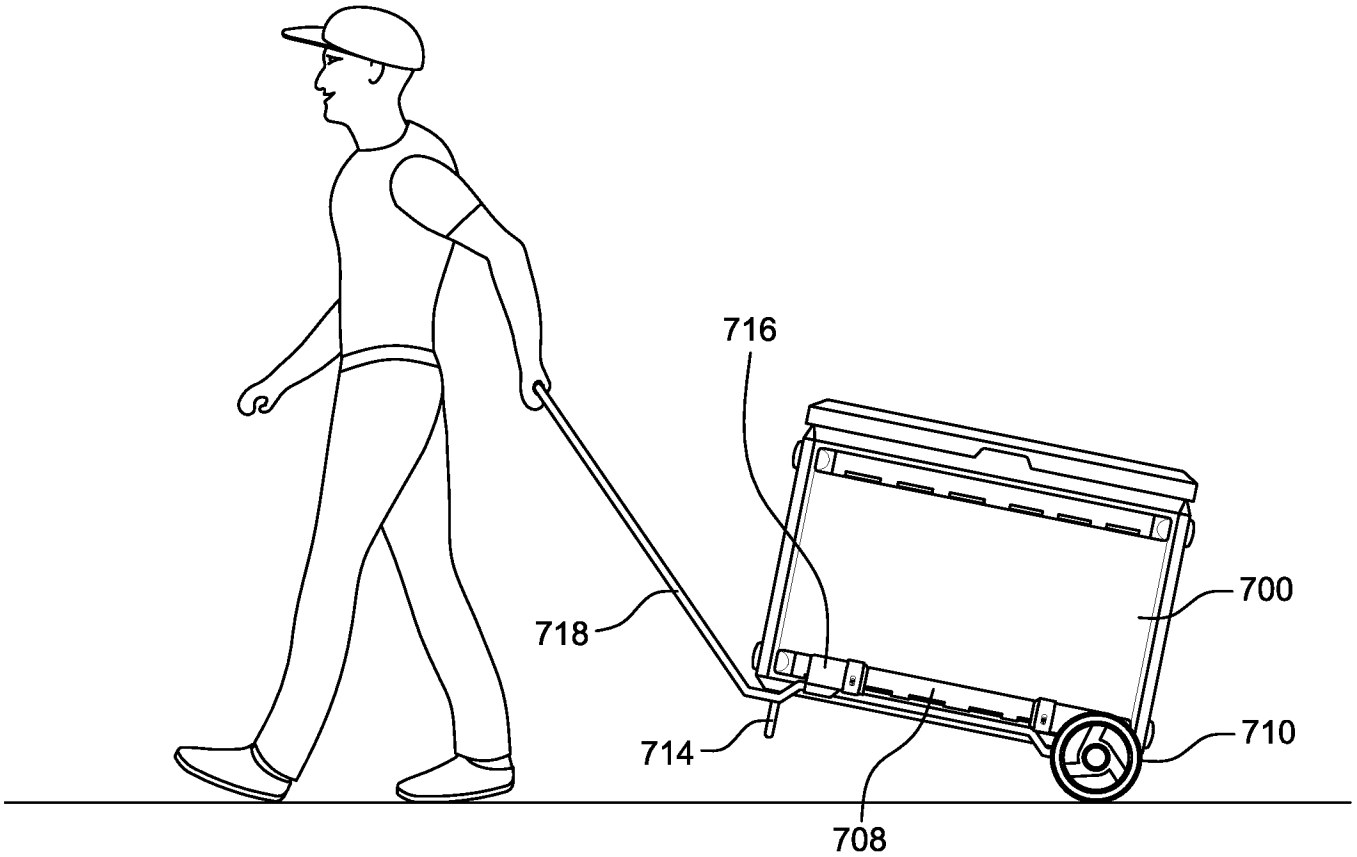
FIG. 7E shows the portable cooler in FIG. 7A being pulled by a user using an extended handle.

Referring now to FIG. 6A, a cooler 600 includes a box portion 602 having a lid 604. Disposed on an exterior surface 606 of the cooler 600 are rails 608. Mounted to the rails 608 are wheel accessories 610, each of which includes a wheel 612 and an accessory mounting assembly 614. It will be appreciated that the accessory mounting assemblies 614 may removably attach the wheels 612 to the rails 608. Attached to the lid 604 are seats 616. As shown in FIGS. 6B and 6D, extending from the bottom of the seats 616 are projections 618 that are configured and adapted to engage the cup holders 620 formed in the top surface of the lid 604 of the cooler 600. In an embodiment, the projections 618 frictionally engage the cup holders 620 to both align and secure the seats 616 to the cooler 600. Similarly, as shown in FIG. 6C, a bench cushion 622 may also be installed in a similar manner. In particular, modular panels 624 installed onto a bottom surface of the cushion 622. Projections 626 may extend downwardly row the panels 624. The projections 626 are configured and adapted to frictionally engage the cup holders 620 of the lid 604 in order to secure the cushion 622 to the cooler 600.

Referring now to FIG. 7A-7D, there is depicted a cooler 700. The cooler 700 includes a box portion 702 and a lid 704. Disposed on an exterior surface 706 of the cooler 700 are accessory attachment rails 708. Attached to the rails 708 is a pair of wheels 710. In addition, a cradle 712 may be attached to the rails 708 and may reside underneath the cooler 700. The cradle 712 may include a strut 714 that allows the cooler 700 to sit level with the wheels 710. The cradle 712 may be connected to the rails 708 using the mounting assemblies 716. As shown in 7E, an extension handle 718 may be attached to the rails 708 using the mounting assemblies 716. The extension handle 718 may be utilized to raise the strut 714 off of the ground such that the cooler 700 is supported on the wheels 710.

Figure 10:
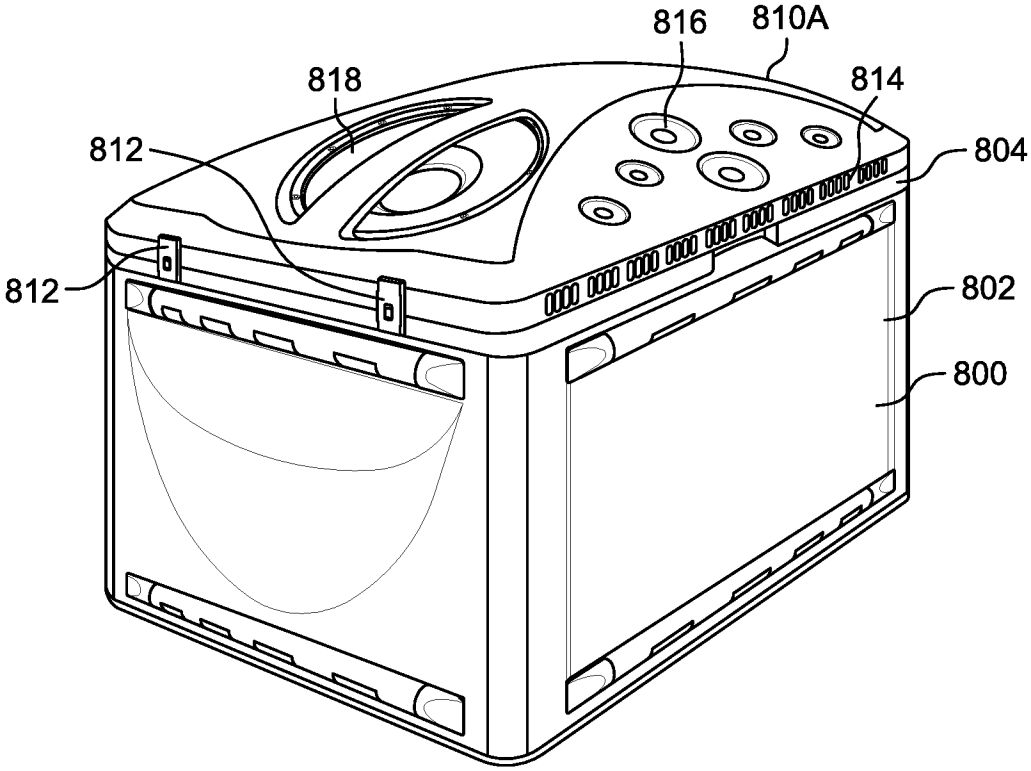
FIG. 10 is a perspective view of a portable cooler with a lid-speaker system attached to its lid according to an embodiment of the present disclosure.
Figure 11:
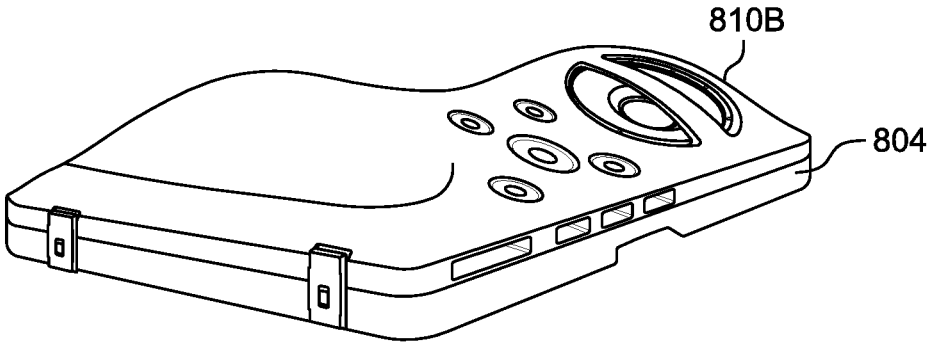
FIG. 11 is a perspective view of a lid for a cooler with a lid-speaker system attached thereto.
Figure 12:
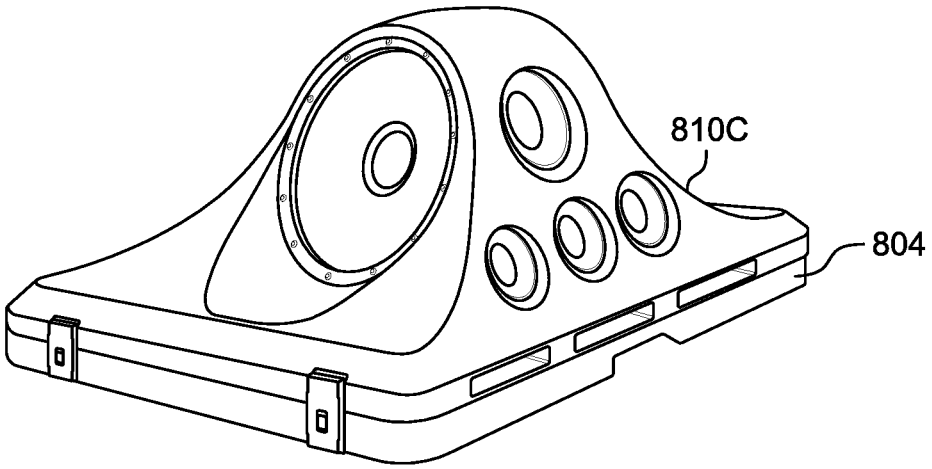
FIG. 12 is a perspective view of a lid for a cooler with a lid-speaker system attached thereto.

Referring now to FIG. 10, there is depicted a cooler 800 having a box portion 802 and lid 804. Disposed on the cooler 800 is a lid-based speaker system 810A. In particular, the system 810A is attached to the lid 804 using latches 812. The system 810A may include a slotted sound chamber 814 as well as speakers 816 and sub-woofer 818. Shown in FIG. 11, is an alternative embodiment of the lid-based speaker system 810B attached to the lid 804. Shown in FIG. 12, is an alternative embodiment of the lid-based speaker system 810C attached to the lid 804.

Figure 13B:
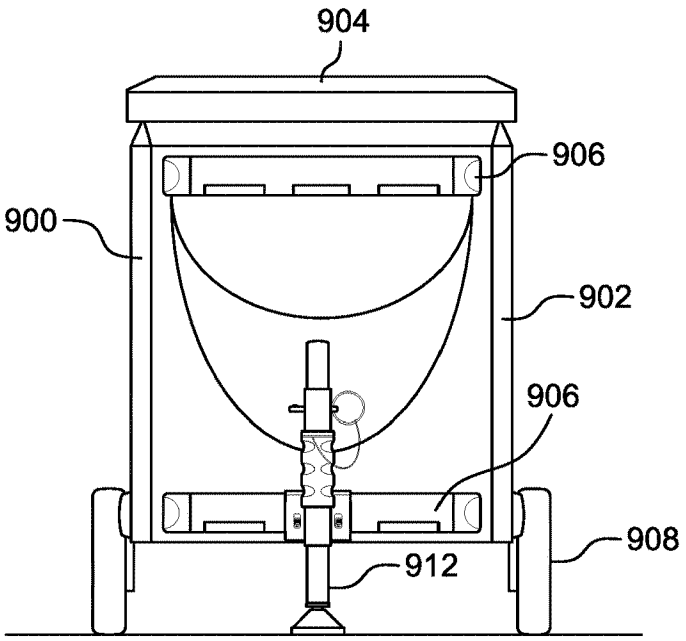
FIG. 13B is a side view of a portable cooler with modular wheel accessories and a leg accessory as shown in FIG. 13A.
Figure 13A:
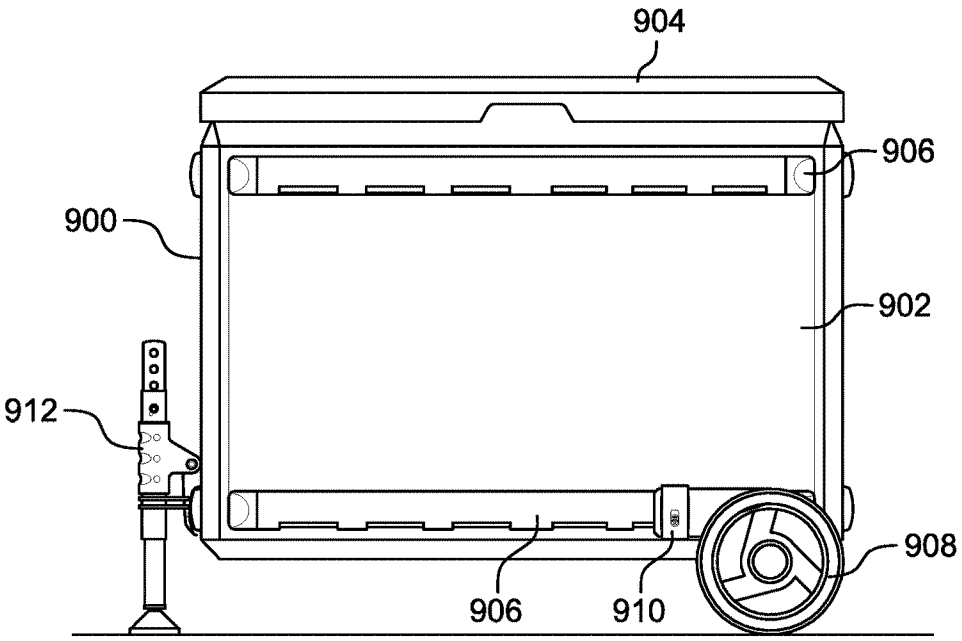
FIG. 13A is a front view of a portable cooler with modular wheel accessories and a leg accessory.

Referring now to FIGS. 13A and 13B, there is depicted a cooler 900 according to an embodiment of the present disclosure. The cooler 900 comprises a box portion 902 and a lid 904. The cooler 900 may include accessory mounting rails 906. Mounted on the rails 906 is a pair of wheels 908 using mounting assemblies 910. A leveling strut or leg 912 may be attached to the rail 906.

Figure 13C:
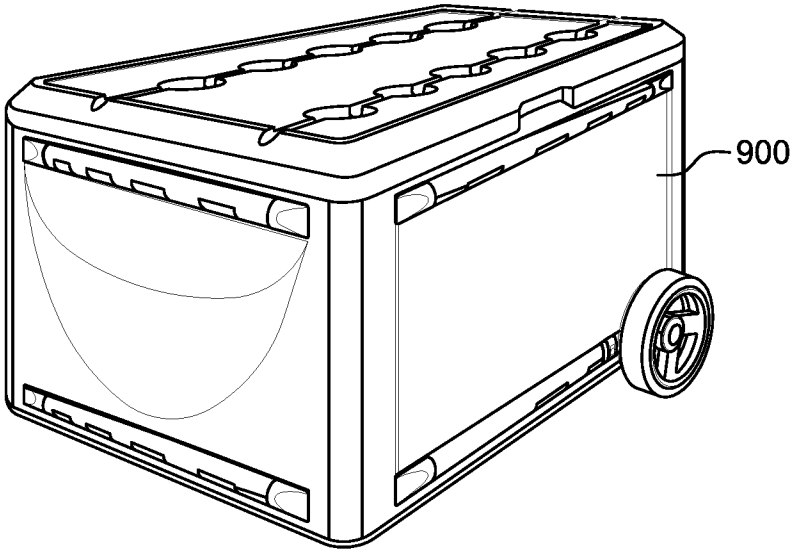
FIG. 13C is a perspective view of a portable cooler with modular wheel accessories according to an embodiment of the present disclosure.
Figure 13D:
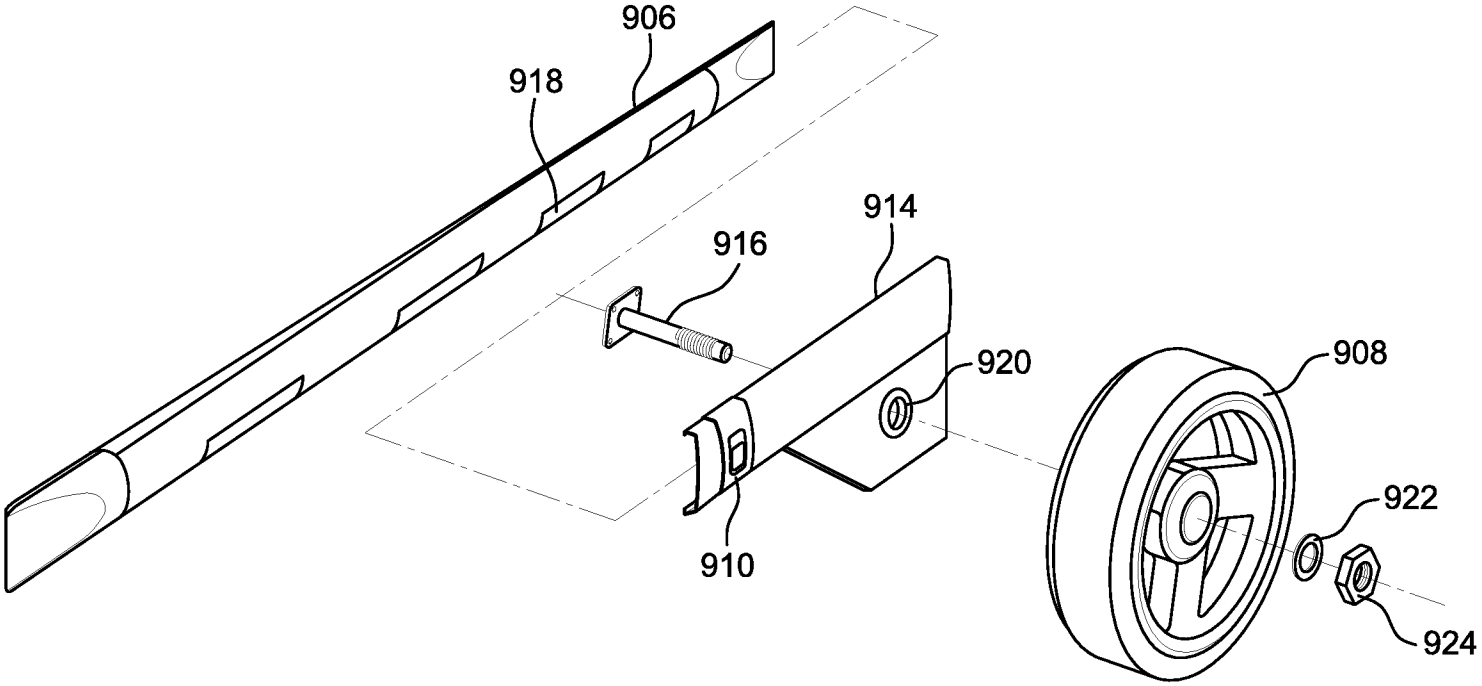
FIG. 13D is an exploded view of a modular wheel accessory according to an embodiment of the present disclosure.
Figure 13F:
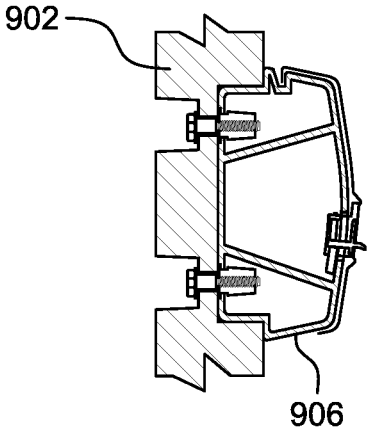
FIG. 13F is a cross-sectional view of a rail with the mounting assembly shown in FIG. 13E.
Figure 13E:
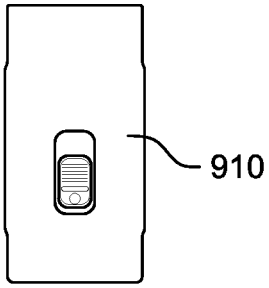
FIG. 13E is a mounting assembly for attaching a modular wheel accessory to a rail of a portable cooler.
Figure 13G:
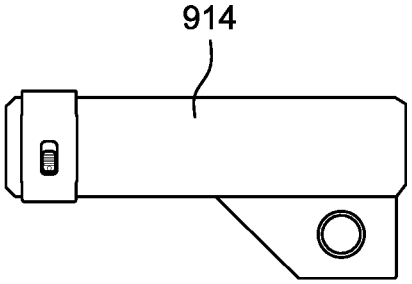
FIG. 13G is a mounting bracket for a modular wheel accessory.

Referring now to FIGS. 13D-13F, each of the wheels 908 may be mounted onto the rails 906 using a mounting assembly 910. The mounting assembly 910 may include a bracket 914 and a bolt 916. In particular, the bolt 916 may be installed into a slot 918 in the rail 906. The bracket 914 includes a bore 920 for receiving the shaft of the bolt 916. The wheel 908 is then mounted onto a shaft of the bolt 916 and is secured with a washer 922 and nut 924. As shown in FIG. 13C, the cooler 900 may be utilized with the leg 912 removed.

Figure 14:
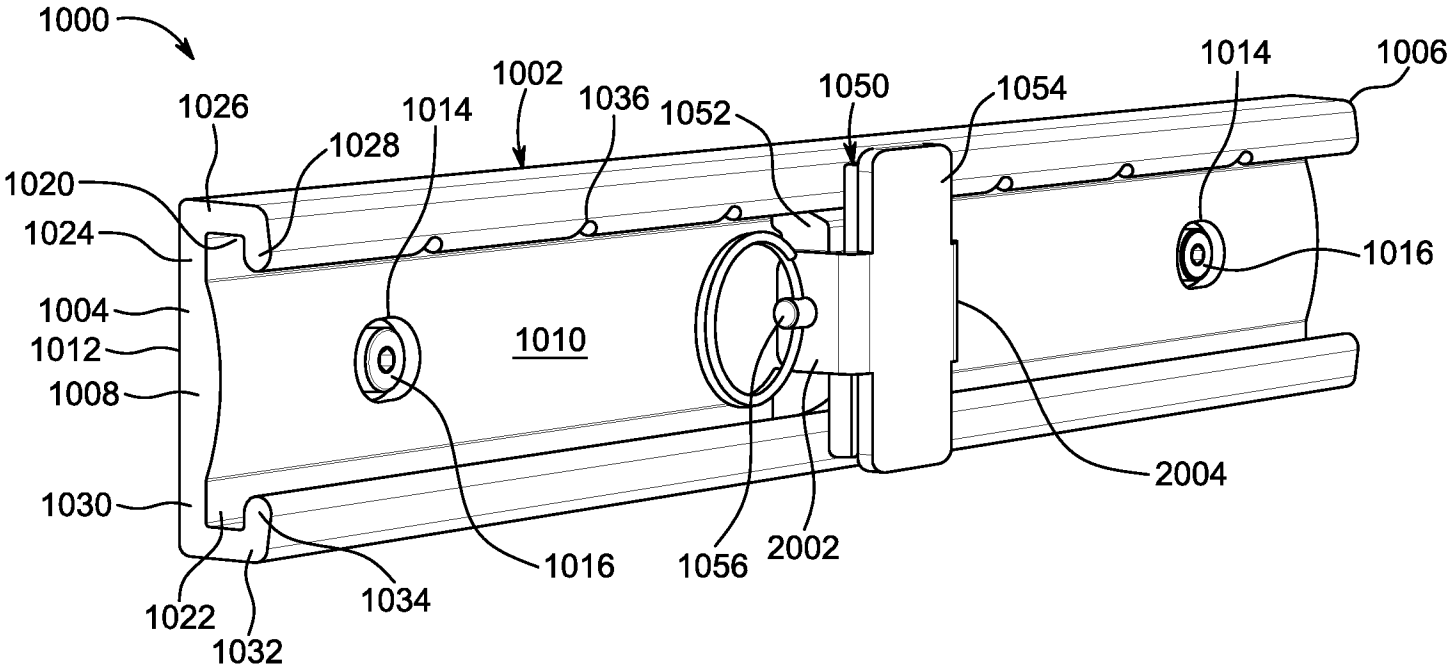
FIG. 14 is a perspective view of an accessory mounting system that includes a rail and accessory mounting assembly according to an embodiment of the present disclosure.

Referring now to FIG. 14, there is depicted an accessory mounting system 1000 according to an embodiment of the present disclosure. The system 1000 may include an elongated support rail 1002 extending between a first end 1004 and a second end 1006. In an embodiment, the rail 1002 is extruded from metal, such as aluminum and the like. In an embodiment, the rail 1002 is formed from plastic. In an embodiment, the rail 1002 is configured and adapted for attachment to a support structure (not shown). For example, the rail 1002 may be utilized on a portable cooler similar to the rail 208 discussed above. In an embodiment, the rail 1002 may be attached to a wall, floor, gunnel or some other structure.

The rail 1002 includes a wall 1008 defining a front surface 1010 and a back surface 1012. The wall 1008 may include countersunk bores 1014 extending from the front surface 1010 to the back surface 1012. Fasteners 1016 may be utilized to secure the rail 1002 to a structure, such as a cooler, wall or floor. It will be appreciated that the fasteners 1016 may include, without limitation, appropriate mounting hardware such as screws, bolts, lag bolts, nails, pins and the like. It will be further appreciated that although two bores 1014 are shown on the rail 1002, that the rail 1002 may include any number of bores 1014 and fasteners 1016 depending on the application.

Formed in a top portion of the rail 1002 is a first guide channel 1020 extending longitudinally along the rail 1002 from the first end 1004 to the second end 1006. Formed in a bottom portion of the rail 1002 is a second guide channel 1022 extending longitudinally along the rail 1002 from the first end 1004 to the second end 1006. Referring now to the first channel 1020, it is generally C-shaped and is defined by a vertical portion 1024 of the wall 1008, a forwardly extending portion 1026 of the wall 1008, and a downwardly extending portion 1028 of the wall 1008. Similarly, the second channel 1022 is generally C-shaped and is defined by a vertical portion 1030 of the wall 1008, a forwardly extending portion 1032 of the wall 1008, and an upwardly extending portion 1034 of the wall 1008. Formed in a lowermost surface of the downwardly extending portion 1028 of the wall 1008 are a plurality of locking grooves 1036, the purpose of which will be explained in more detail hereinafter.

Installed onto the rail 1002 is an accessory mounting assembly 1050. The assembly 1050 may allow accessories to be attached to the rail 1002 in a manner that will be described in more detail hereinafter. In an embodiment, the assembly 1050 is discretely positionable along a longitudinal axis of the rail 1002. In an embodiment, the assembly 1050 is removably attachable to the rail 1002. In an embodiment, multiple assemblies 1050 may be attached to the rail 1002 in order to allow multiple accessories to be attached to the rail 1002. In an embodiment, the assembly 1050 comprises a rail clamp 1052, an accessory-mounting bracket 1054, and a locking pin 1056. In embodiments, the rail 1002 may formed from a metal or a plastic. In an embodiment, the rail 1002 is formed by an extrusion process. In an embodiment, the rail clamp 1052 is formed from a metal or a plastic.

Figure 15:
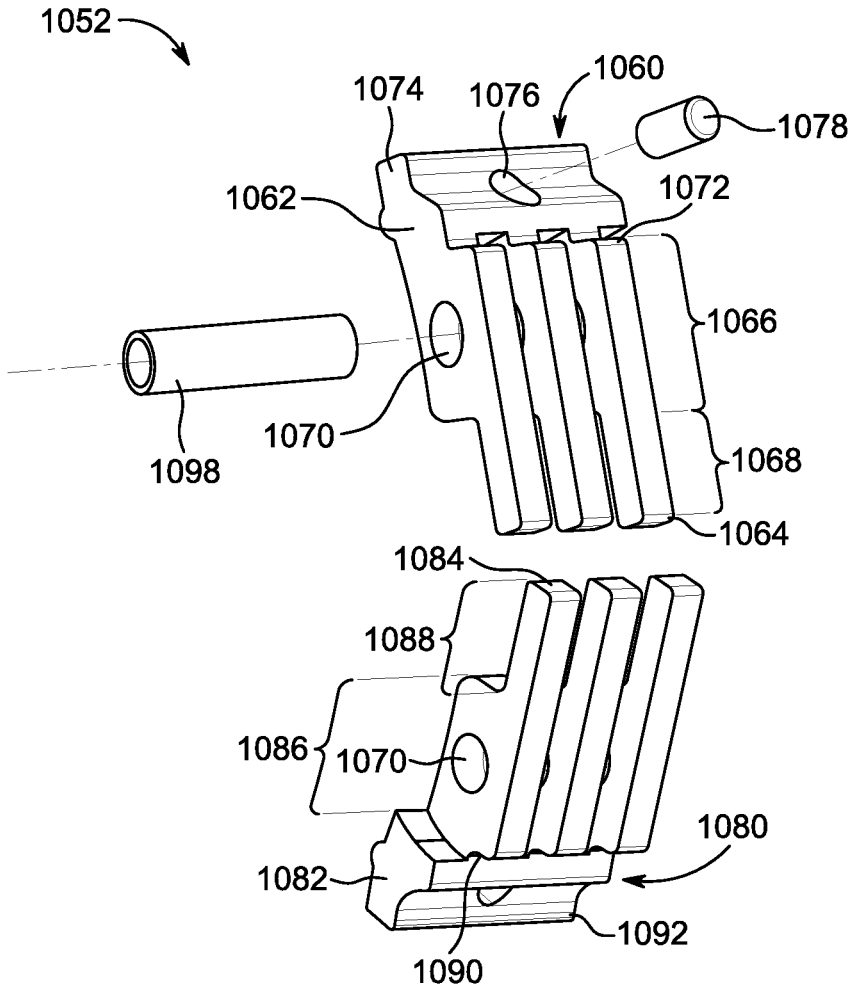
FIG. 15 is an exploded view of the accessory mounting clamp for use with the accessory mounting system shown in FIG. 14.
Figure 16:
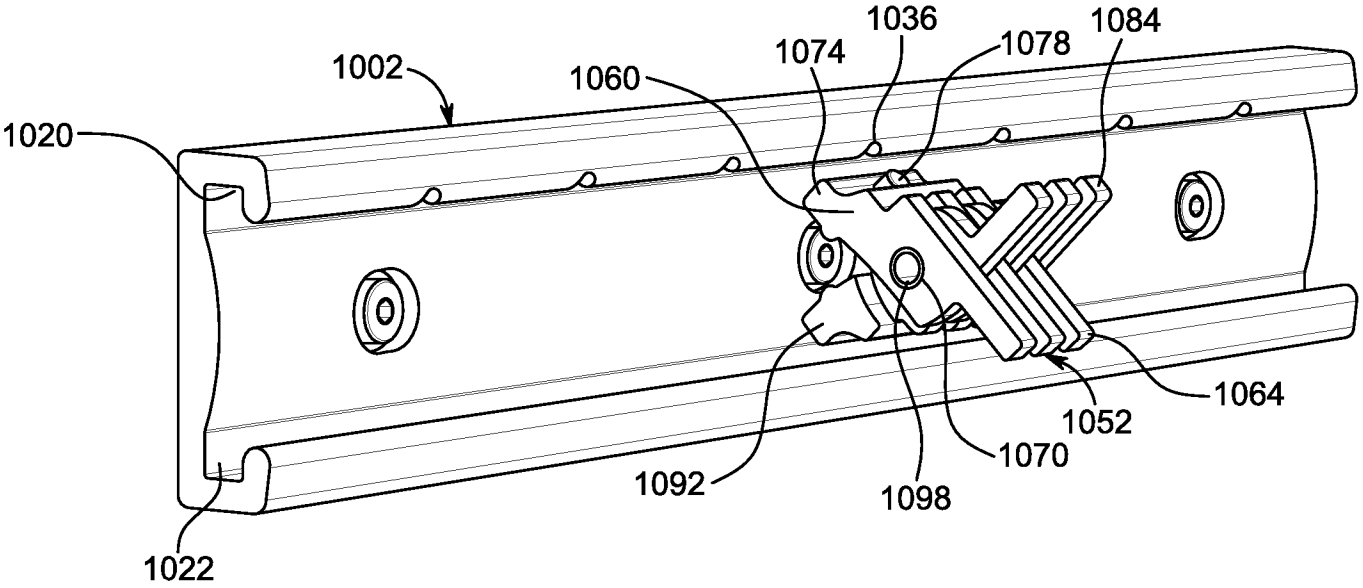
FIGS. 16-18 depict a procedure for installing an accessory mounting clamp onto a rail of the accessory mounting system shown in FIG. 14.
Figure 17:
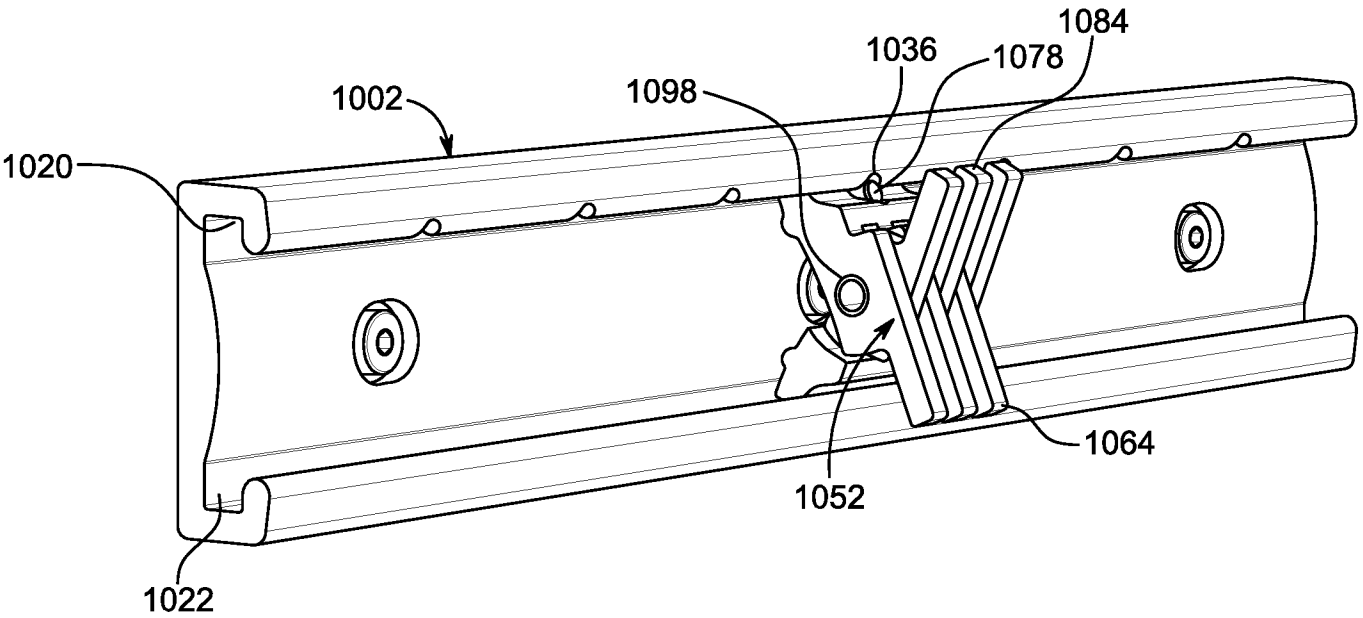
Figure 18:
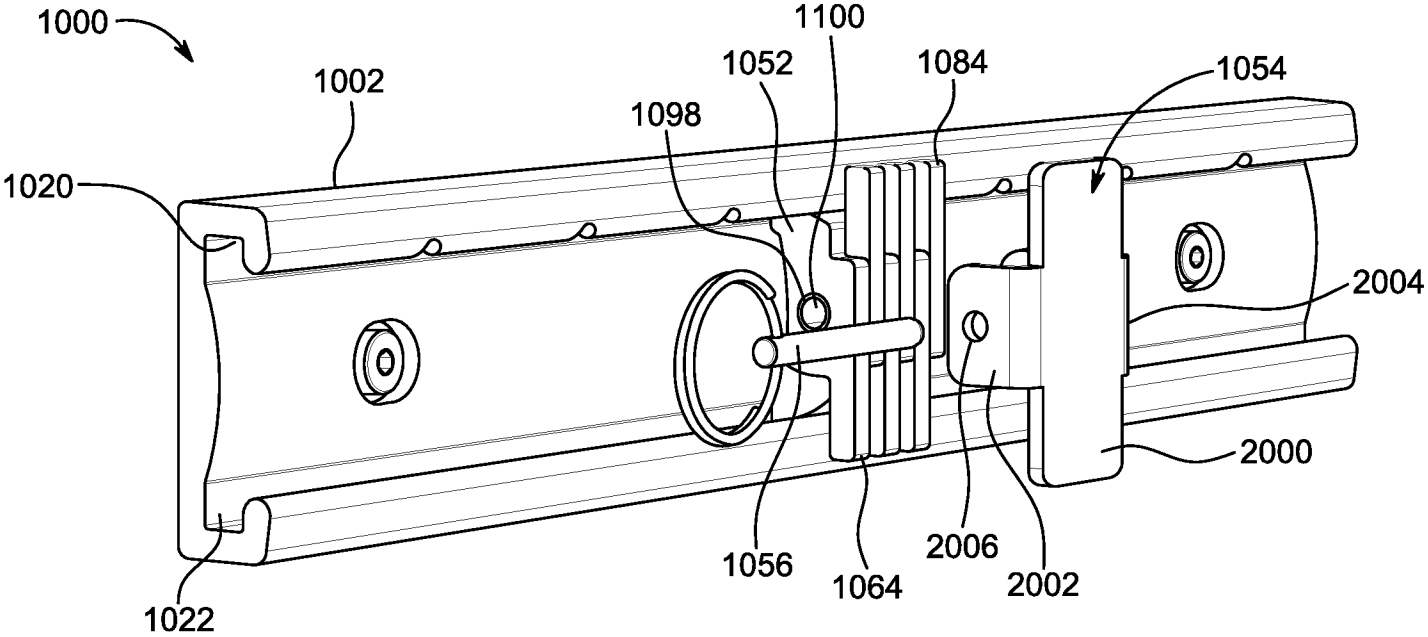
Figure 19:
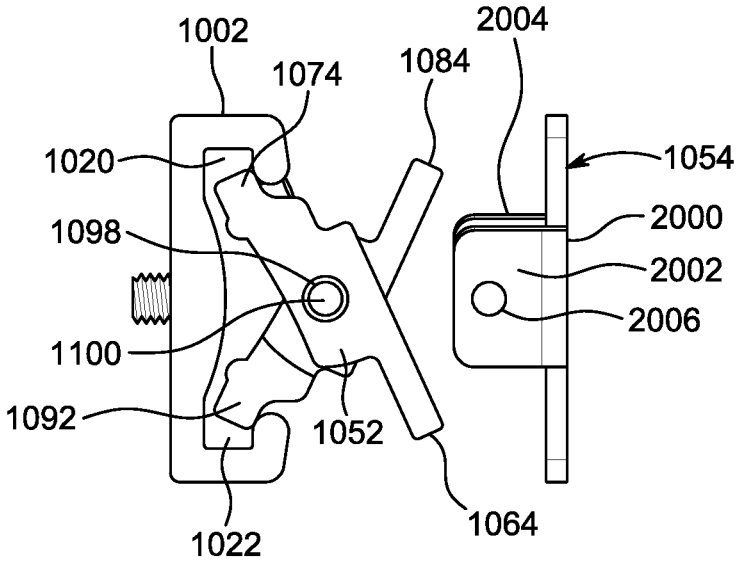
FIGS. 19 and 20 are side views of a procedure for installing the accessory mounting clamps onto the rail.
Figure 20:
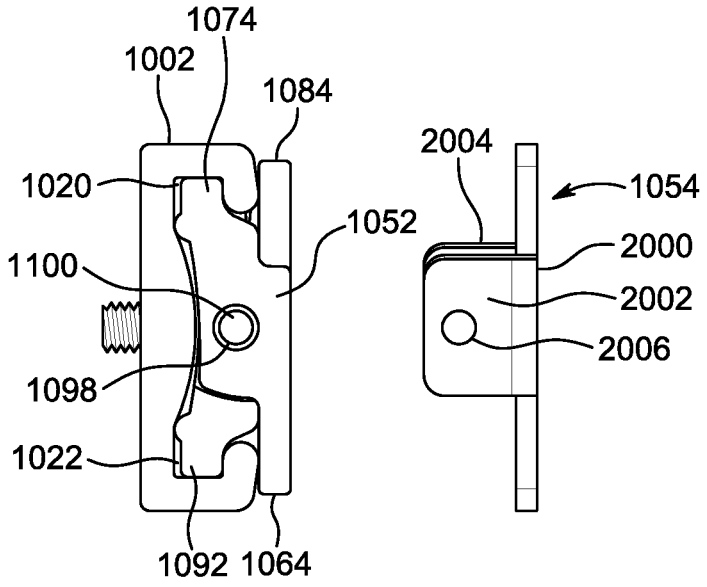

Referring now to FIG. 15, the rail clamp 1052 comprises a first lever 1060 and a second lever 1080 that are pivotally joined together by a bushing 1098 to form a scissor-like configuration (see FIG. 16). The first lever 1060 includes a base portion 1062. Extending from the base portion 1062 is a plurality of spaced apart fingers 1064. Each of the fingers 1064 comprises a proximal portion 1066 and a distal portion 1068, where the proximal portion 1066 is nearest the base portion 1062. A thickness of the proximal portion 1066 is greater than that of the distal portion 1068. Formed in the proximal portion 1066 of each of the fingers 1064 is a bore 1070 for receiving the bushing 1098. A rear surface 1072 of each of the fingers 1064 is raised with respect to the base portion 1062 and defines a seat. Formed in a topmost portion of the base portion 1062 is a tongue 1074 configured and adapted to be inserted into one of the channels (1020 or 1022) of the rail 1002 (see FIG. 14). Formed in a face of the base portion 1062 is a bore 1076 configured and adapted to receive a guide pin 1078, the purpose of which will be described in detail hereinafter.

The second lever 1080 is similar in configuration to the first lever 1060 and includes a base portion 1082. Extending from the base portion 1082 is a plurality of spaced apart fingers 1084. Each of the fingers 1084 comprises a proximal portion 1086 and a distal portion 1088, where the proximal portion 1086 is nearest the base portion 1082. A thickness of the proximal portion 1086 is greater than that of the distal portion 1088. Formed in the proximal portion 1086 of each of the fingers 1084 is a bore 1070 for receiving the bushing 1098. A rear surface 1090 of each of the fingers 1084 is raised with respect to the base portion 1082 and defines a seat. Formed in a lowermost portion of the base portion 1082 is a tongue 1092 configured and adapted to be inserted into one of the channels (1020 or 1022) of the rail 1002 (see FIG. 14).

Referring now to FIG. 16, with the bushing 1098 installed into the bore 1070 of the first lever 1060 and the second lever 1080, their fingers 1064 and 1084, respectively, are operable to cross each other or open and close like the blades of a pair of scissors. Further, when the rail clamp 1052 is assembled, the fingers 1064 and 1084 are interlaced.

With reference to FIGS. 16-21, where like reference numerals depict like components, the manner of installing and securing the rail clamp 1052 onto the rail 1002 will now be described. With the fingers 1064 and 1084 are brought together, the tongues 1074 and 1092 of the clamp 1052 are positioned into the center of the rail 1002 and between the channels 1020 and 1022. The pin 1078 should be in alignment with one of the locking grooves 1036. To lock the clamp 1052 onto the rail 1002, a force is applied to each the fingers 1064 and 1084 to cause the fingers 1064 and 1084 to angularly separate. As the fingers 1064 and 1084 separate, the tongues 1074 and 1092 are forced into channels 1020 and 1022. When fully closed, the angle formed between the fingers 1064 and 1084 is about 180 degrees and the tips of the fingers are facing away from each other. Further, the guide pin 1078 is engaged into a selected one of the locking grooves 1036. In this regard, the pin 1078 and the grooves 1036 provide discrete mounting positions for the clamp 1052 on the rail 1002. In an embodiment, when fully closed, the clamp 1052 may be locked into place using an over-the-center locking feature.

Referring now to FIGS. 14 and 18-20, with the clamp 1052 secured to the rail 1002, the accessory-mounting bracket 1054 may be installed onto the clamp 1052. In an embodiment, the bracket 1054 includes a body portion 2000. The body portion 2000 may be substantially planar. Extending rearwardly from the body portion 2000 is a pair of spaced apart wing members 2002 and 2004. Formed in each of the wings 2002 and 2004 is a bore 2006. The space between the wings 2002 and 2004 is configured and adapted to receive the fingers 1064 and 1084 of the clamp 1052. When the bracket 1054 is installed onto the clamp 1052, the bores 2006 in the wings 2002 and 2004 align with a bore 1100 in the hollow bushing 1098. With the bores 2006 and 1100 aligned, the pin 1056 is installed through them in order to secure the bracket 1054 to the clamp 1052. In this manner an accessory may be installed onto the rail 1002.

Figure 21:
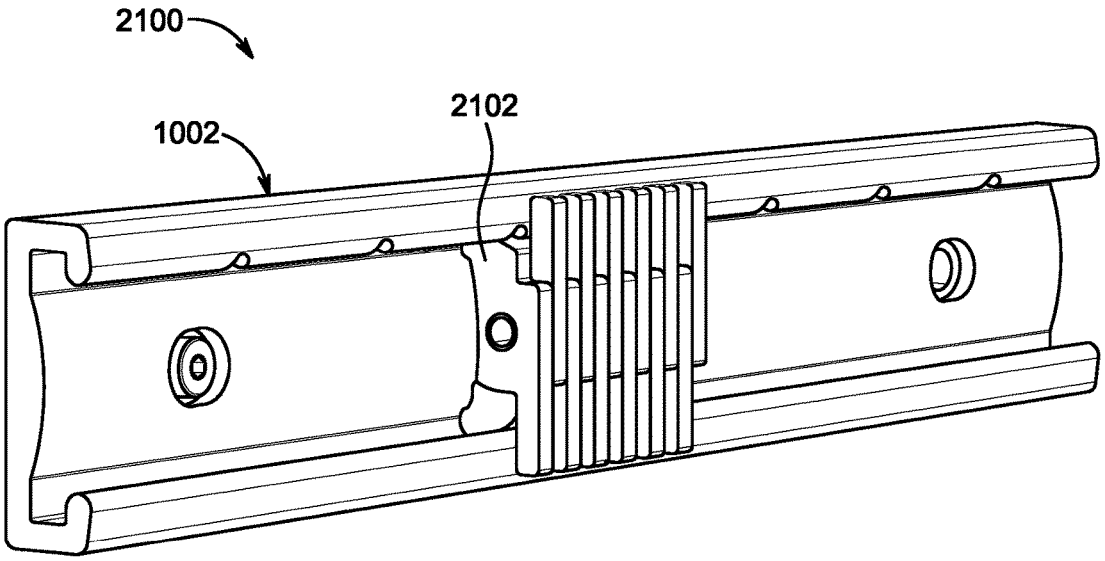
FIG. 21 is a perspective view of a rail and accessory mounting clamp according to an embodiment of the present disclosure.

Referring now to FIG. 21, where like numbers depict like components, there is depicted an accessory mounting system 2100 according to an embodiment of the present disclosure. The system 2100 may include the rail 1002 and a clamp 2102. The clamp 2102 may take substantially the same form as the clamp 1052 except the clamp 2102 may include more interlaced fingers, six on each lever. In this regard, it will be appreciated that a clamp according to an embodiment of the present invention may include 3, 4, 5, 6, 7, or more fingers on each lever. It will be further appreciated that additional fingers on a clamp may allow the clamp to support more weight.

Figure 22:
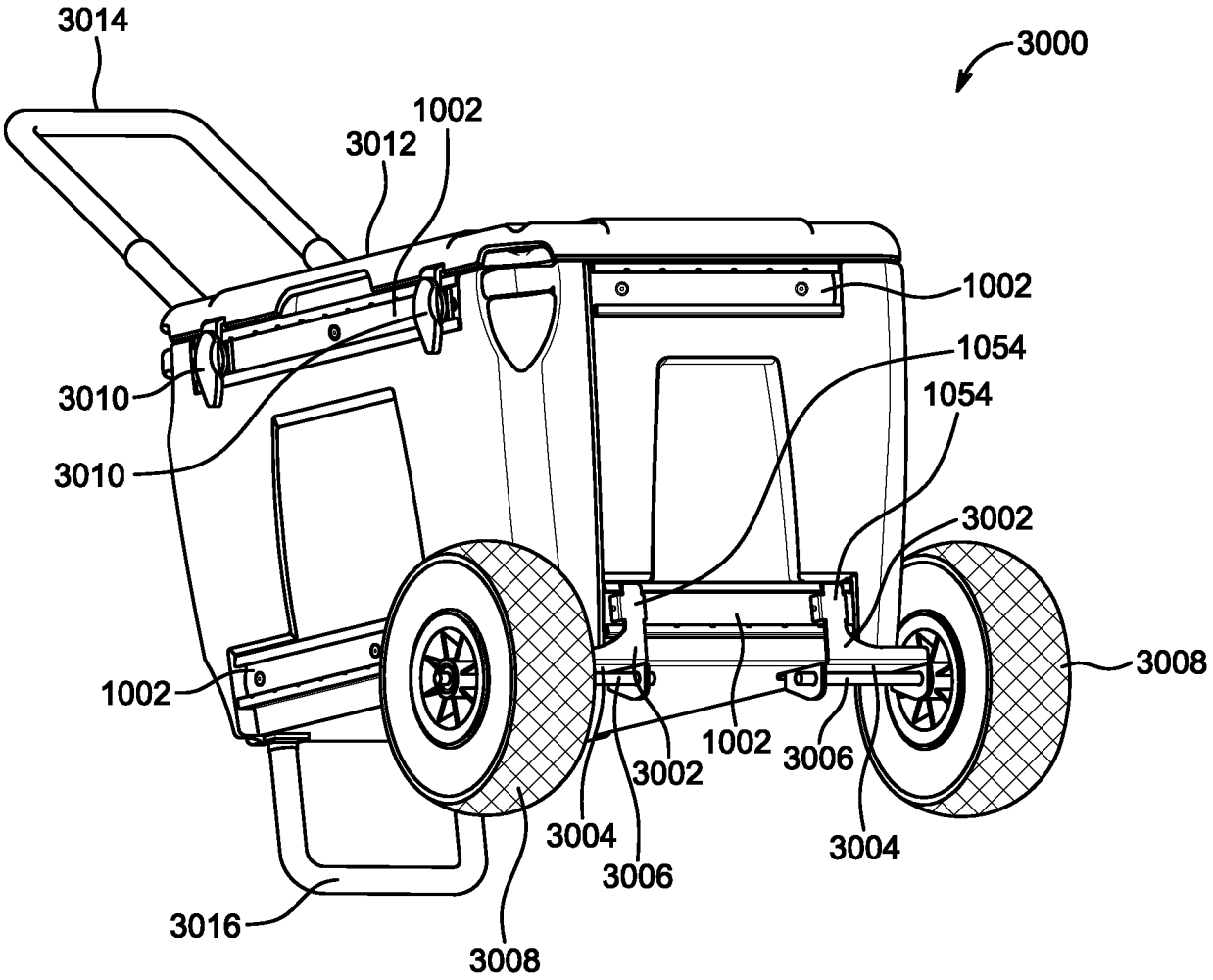
FIGS. 22 and 23 depict a cooler having a handle and wheels mounted thereto using rails and accessory mounting clamps according to an embodiment of the present disclosure.
Figure 23:
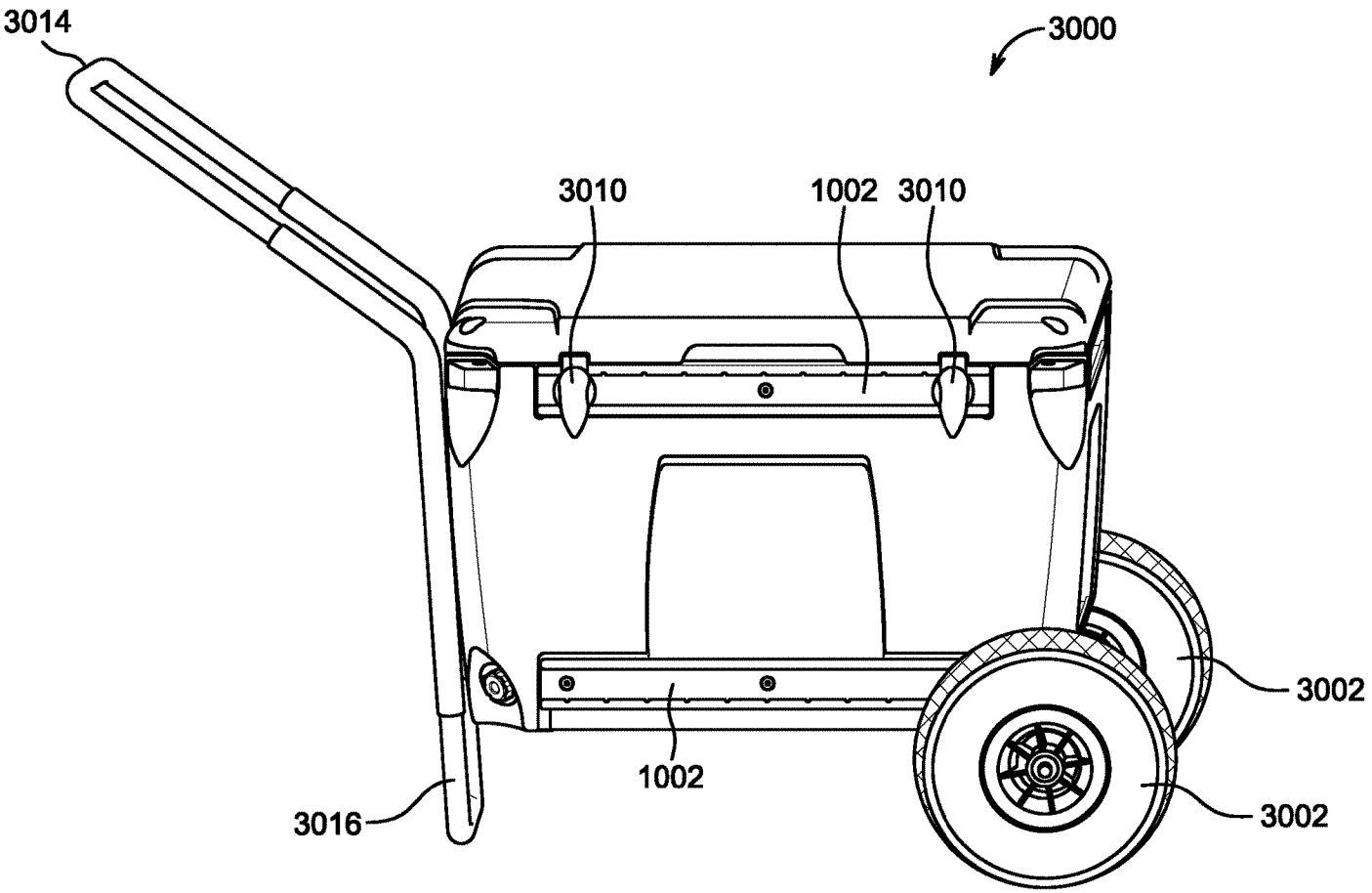

Referring now to FIGS. 22 and 23, there is depicted a cooler 3000 according to an embodiment of the present disclosure. The cooler 3000 may have rails 1002 mounted on each of its sides. In an embodiment, the rails 1002 on each of the sides may include an upper rail and a lower rail. As will now be explained, the rails 1002 may be utilized to attach accessories to the cooler 3000 using clamps 1052. In particular, the clamps 1052 be installed onto any of the rails 1002. Using the clamps 1052, a pair of wheel assemblies 3002 may be attached to the cooler 3000. Each of the wheel assemblies 3002 may comprise an arm 3004. Disposed on an end of the arm 3004 is a mounting bracket 1054. The mounting brackets 1054 are configured and adapted to secure the arm 3004 to one of the clamps 1052 (not visible) in the manner described above. Each of the assemblies 3002 may further comprise an axle 3006 and a wheel 3008.

The cooler 3000 may further include closure mechanisms 3010 attached to an upper one of the rails 1002. The closure mechanisms 3010 may be utilized to secure a lid 3012 of the cooler 3000. In this regard, each of the closure mechanisms 3010 includes a mounting bracket 1054 that allows it to be secured to a clamp 1052 (not visible) mounted on the rail 1002. In an embodiment, the closure mechanisms 3010 include latches. In an embodiment, the cooler 3000 may further include a handle 3014. The handle 3014 may be attached to the cooler 3000 using rails 1002, clamps 1052 and mounting brackets 1054. In an embodiment, the cooler 3000 may further include a stand 3016. The stand 3016 may be attached to the cooler 3000 using the rails 1002, clamps 1052 and mounting brackets 1054.

Figure 24:
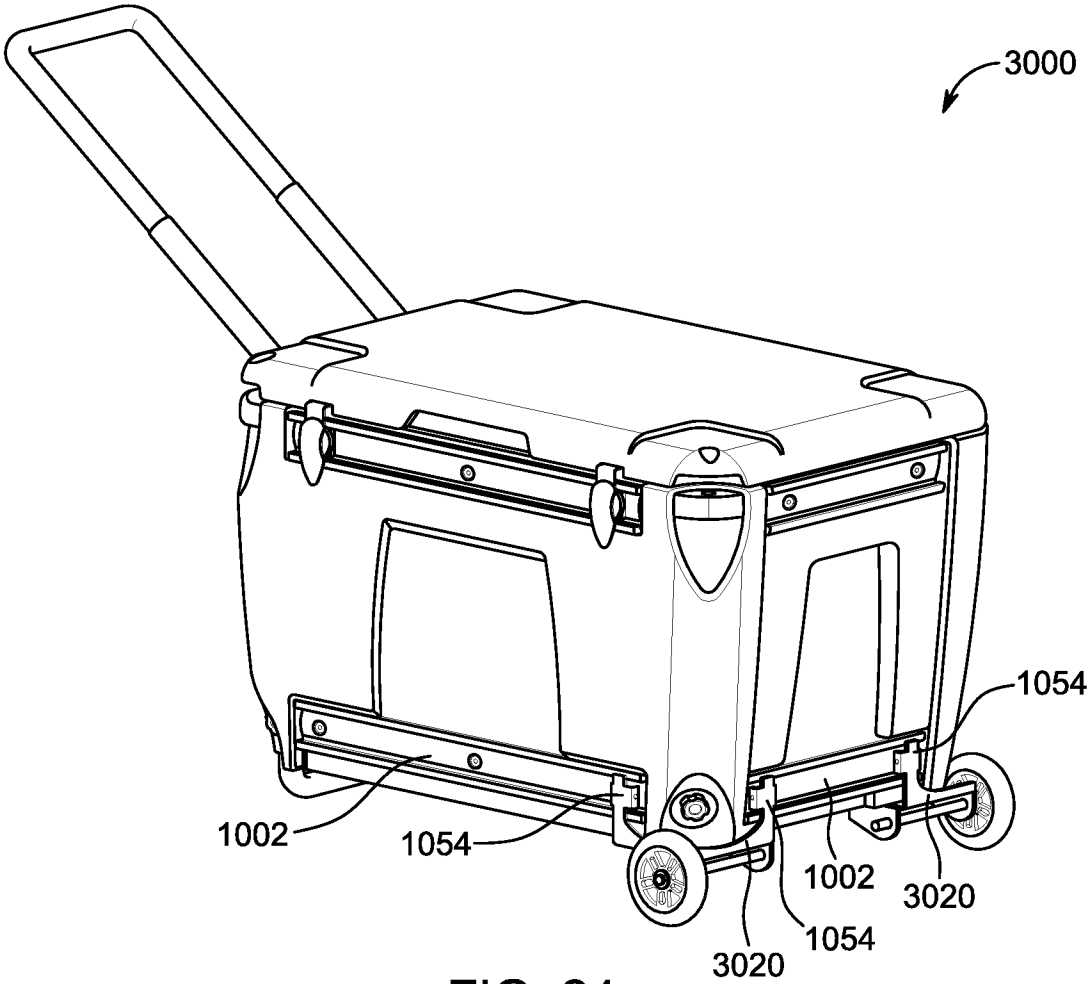
FIGS. 24 and 25 depict a cooler having a handle and wheels mounted thereon using rails and accessory mounting clamps according to an embodiment of the present disclosure.
Figure 25:
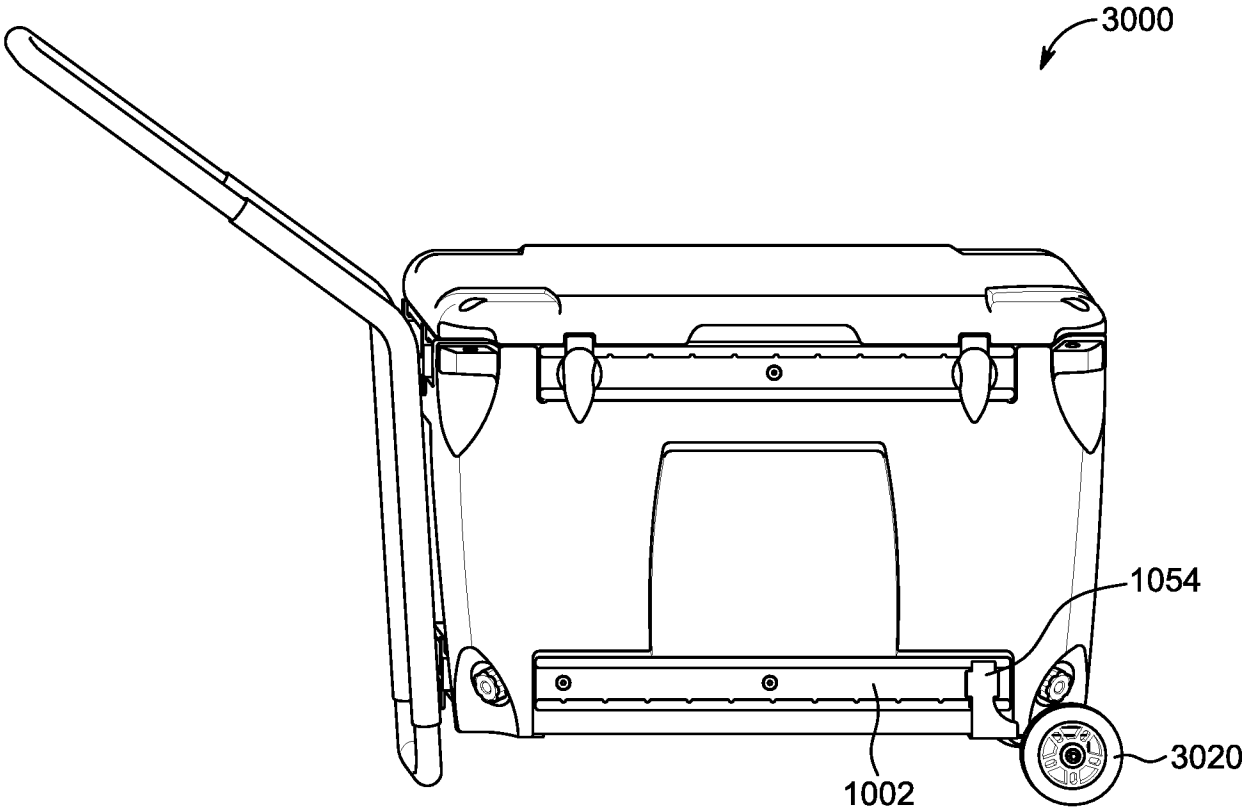

Referring now to FIGS. 24 and 25, in an embodiment, the cooler 3000 includes a pair of wheel assemblies 3020. Each of the wheel assemblies 3020 comprises a pair of mounting brackets 1054 that allows it to be secured to rails 1002 on adjacent sides of the cooler 3000. In this regard, the brackets 1054 are each mounted on an arm.

In an embodiment, different accessories may be mounted to the cooler 3000 using rails 1002, clamps 1052, and mounting brackets 1054. In this regard, the mounting brackets 1054 may be incorporated into the designs of different accessories, including rod holders, speakers, seats, tie downs, umbrellas, canopies, shade covers, tables, cutting boards, wheels, storage containers, pouches, bags, drink holders, leveling struts, extendable legs, handles, stands, wheel assemblies, and a cradle system. In this regard, all that is required is that the accessory have at least one extension arm onto which a mounting bracket 1054 is attached.

It will be appreciated that the embodiments of the rail mounting system described above can be utilized to mount various objects to structures. In an embodiment, the rail mounting system can be utilized to mount rows of seating, such as seating utilized in an airplane. In such an embodiment, the rails may be mounted to the floor of the airplane and the support framework for the seating may include mounting brackets for attachment to the clamps installed onto the rails. In an embodiment, the rail mounting system can be utilized to mount storage receptacles to a wall or ceiling as is in the case of garage organizers. In such an embodiment, the rails may be mounted to walls or ceilings. The framework for the storage receptacles may include mounting brackets for attachment to the clamps installed onto the rails. In an embodiment, the rail mounting system can be utilized to mount items to a roof of a vehicle, such as cargo and travel containers and the like. In such an embodiment, the rails may be permanently mounted to the roof of the vehicle. The cargo and travel containers may include a framework having mounting brackets for attachment to the clamps installed onto the rails. In an embodiment, the rail mounting system can be utilized to mount items to bed of a vehicle, such as cargo and travel containers and the like. In such an embodiment, the rails may be permanently mounted to the bed of the vehicle. The cargo and travel containers may include a framework having mounting brackets for attachment to the clamps installed onto the rails. In an embodiment, the rail mounting system can be utilized to mount items to a watercraft, such as cargo and travel containers and the like. In such an embodiment, the rails may be permanently mounted to the gunnels of the watercraft. The cargo and travel containers may include a framework having mounting brackets for attachment to the clamps installed onto the rails. In an embodiment, the rail mounting system can be utilized as a tie down system for trailers and truck beds. In such an embodiment, the rails may be permanently mounted to the trailers and truck beds. The tie downs may include a framework having mounting brackets for attachment to the clamps installed onto the rails. In an embodiment, the rail mounting system can be utilized to mount storage cabinets. In such an embodiment, the rails may be permanently mounted to a wall. The cabinets may include a framework having mounting brackets for attachment to the clamps installed onto the rails.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A portable cooler apparatus comprising:

a box portion having an exterior surface and an interior surface;

the interior surface of the box portion defining a food receptacle;

a lid operable between an open position and a closed position;

a first accessory mounting rail on the exterior surface of the box portion; and a mounting assembly for attaching an accessory to the first accessory mounting rail;

wherein said mounting assembly comprises a clamp operable between a first position and a second position;

wherein said clamp is configured and dimensioned to securely clamp onto said first accessory mounting rail when operated to the second position;

wherein the clamp comprises a first lever and a second lever, wherein the first lever and the second lever are pivotally mounted together in a scissor-like configuration.

2. The apparatus of claim 1, wherein each of the first lever and the second lever comprises a plurality of spaced apart fingers, wherein the fingers of the first lever and the fingers of the second lever are interlaced.

3. The apparatus of claim 1, wherein said mounting assembly further comprises a mounting bracket configured and dimensioned to engage said clamp, wherein said mounting bracket is connected to said accessory.

4. The apparatus of claim 3, further comprising a pin for securing said mounting bracket to said clamp.

5. The apparatus of claim 1, wherein said first accessory mounting rail comprises a plurality of discrete mounting locations for locating the mounting assembly.

6. The apparatus of claim 5, wherein the mounting assembly comprises a guide pin for locating one of the plurality of discrete mounting locations.

7. The apparatus of claim 5, wherein the discrete mounting locations are one of a plurality of locking grooves and a row of slots formed in the first accessory mounting rail.

8. The apparatus of claim 1, further comprising a second accessory mounting rail on the exterior surface of the box portion.

9. A portable cooler apparatus comprising:

a box portion having an exterior surface and an interior surface;

the interior surface of the box portion defining a food receptacle having an open top;

a lid operable between an open position and a closed position;

wherein the lid seals the cavity when operated to the closed position;

an accessory mounting rail on the exterior surface of the box portion, the accessory mounting rail having a first channel and a second channel;

a clamp having a first lever and a second lever pivotally connected in a scissor-like configuration, each of the first lever and second lever further having a tongue configured and dimensioned to fit into one of the first and second channels;

an accessory having a mounting bracket; and a pin for securing the mounting bracket to the clamp.

10. The apparatus of claim 9, wherein each of the first lever and the second lever of the clamp comprises a plurality of fingers, wherein the fingers of the first lever and the fingers of the second lever are interlaced.

11. The apparatus of claim 10, wherein the first lever and the second lever are pivotally connected using a hollow bushing, wherein the mounting bracket comprises a pair of wings, each of the wings having a bore, wherein the pin extends through the hollow bushing and the bores in the wings of the mounting bracket to thereby secure the mounting bracket to the clamp.

12. The apparatus of claim 9, wherein the accessory mounting rail is secured on the exterior surface of the box portion using at least one fastener.

13. The apparatus of claim 9, wherein the accessory mounting rail comprises a pair of spaced apart accessory mounting rails.

14. The apparatus of claim 9, wherein the accessory is a wheel assembly.

* * * * *